US008402592B2

(12) United States Patent
Byrne et al.

(10) Patent No.: US 8,402,592 B2
(45) Date of Patent: Mar. 26, 2013

(54) FLEX BRUSH APPARATUS AND METHOD

(75) Inventors: James M. Byrne, Wooster, OH (US); Michael Zimmerman, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 756 days.

(21) Appl. No.: 12/545,587

(22) Filed: Aug. 21, 2009

(65) Prior Publication Data

US 2010/0071145 A1 Mar. 25, 2010

Related U.S. Application Data

(60) Provisional application No. 61/091,069, filed on Aug. 22, 2008.

(51) Int. Cl.
*A46B 9/08* (2006.01)

(52) U.S. Cl. ..... 15/203; 15/169; 15/201

(58) Field of Classification Search ..... 15/168, 15/176.6, 178, 193, 201, 202, 203, 169, 184
See application file for complete search history.

(56) References Cited

U.S. PATENT DOCUMENTS

| | | | | | |
|---|---|---|---|---|---|
| 805,431 | A | | 11/1905 | Fetters | |
| 1,374,010 | A | * | 4/1921 | Henkle | 15/203 |
| 1,646,182 | A | | 10/1927 | Beck | |
| 1,649,490 | A | | 11/1927 | Schalle | |
| 2,159,432 | A | * | 5/1939 | Enns | 15/185 |
| 2,246,773 | A | * | 6/1941 | Adams | 15/201 |
| 2,490,159 | A | | 12/1949 | Ricchiuti | |
| 2,509,013 | A | | 5/1950 | Parks | |
| 2,558,290 | A | | 6/1951 | Brown et al. | |
| 2,629,125 | A | | 2/1953 | Ferguson | |
| 2,712,145 | A | | 7/1955 | Karnes | |
| 2,732,578 | A | | 1/1956 | Hawkins | |
| 3,205,524 | A | | 9/1965 | Stormyr | |
| 3,757,376 | A | | 9/1973 | Coombes | |
| 3,783,468 | A | * | 1/1974 | Saloutos | 15/202 |
| 3,874,021 | A | * | 4/1975 | Jacobs | 15/202 |
| 4,469,223 | A | | 9/1984 | Smith | |
| 1,904,260 | A | | 4/1993 | Aki | |
| 5,218,733 | A | * | 6/1993 | Leu | 15/146 |
| 5,289,606 | A | * | 3/1994 | Ledingham | 15/168 |
| 5,343,585 | A | | 9/1994 | Howell | |
| 5,678,276 | A | * | 10/1997 | Ledingham et al. | 15/168 |
| 5,778,479 | A | | 7/1998 | Raia | |
| 6,035,481 | A | * | 3/2000 | Douglas et al. | 15/168 |
| 7,059,006 | B1 | * | 6/2006 | Huff et al. | 15/146 |
| 7,805,797 | B2 | * | 10/2010 | Douglas et al. | 15/202 |
| 7,895,696 | B2 | * | 3/2011 | Belmonte | 15/106 |
| 2002/0148058 | A1 | * | 10/2002 | Greenwood et al. | 15/168 |

* cited by examiner

*Primary Examiner* — Monica Carter
*Assistant Examiner* — Michael Jennings
(74) *Attorney, Agent, or Firm* — Roger Emerson; Emerson Thomson Bennett

(57) ABSTRACT

A brush includes a first tuft holder having at least one tuft, a second tuft holder having at least one tuft, a support structure having a handle to grasp and use the brush, an adjustment mechanism for adjusting the brush between (1) a first condition where the first and second tuft holders are not movable with respect to each other; and, (2) a second condition where the first tuft holder is movable with respect to the second tuft holder, and wherein the first and second tuft holders remain attached to the support structure in the first and second conditions.

13 Claims, 29 Drawing Sheets

Section A-A

FLEX BRUSH APPARATUS AND METHOD

This application claims priority to U.S. Ser. No. 61/091,069 titled FLEX BRUSH APPARATUS AND METHOD, filed Aug. 22, 2008, which is incorporated herein by reference.

I. BACKGROUND OF THE INVENTION

A. Field of Invention

The present invention generally relates to brushes and, more specifically, relates to methods and apparatuses related to the construction and cleaning of paint brushes.

B. Description of the Related Art

Paint brushes for residential and commercial use have a well established form. Paint brushes generally have a wooden, plastic, or metal handle and a metal ferrule for securing natural or synthetic bristles to the handle. Paint brushes are made in a wide variety of styles and sizes. Paint brushes can be used several times if they are properly cleaned after each use.

A proper and thorough cleaning of a paint brush can be difficult due to the close proximity of the bristles to each other. This close proximity works well when painting, but makes it difficult to remove all the paint during cleaning.

In order to overcome these difficulties, it is desirable to provide a paint brush that operates optimally for painting but also is easier to clean than known paint brushes.

II. SUMMARY OF THE INVENTION

According to one embodiment of this invention, a brush may include: a first tuft holder including at least one tuft; a second tuft holder including at least one tuft, wherein the second tuft holder is operatively attached to the first tuft holder; a support structure including a handle to grasp and use the brush, wherein the first and second tuft holders are slidably attached to the support structure; an adjustment mechanism for adjusting the brush between (1) a first condition where the first and second tuft holders are not movable with respect to each other; and, (2) a second condition where the first tuft holder is movable with respect to the second tuft holder; wherein the first and second tuft holders remain attached to the support structure in the first and second conditions. The first tuft holder may be pivotally attached to the second tuft holder with a hinge. The first tuft holder may pivot with respect to the second tuft holder when the brush is in the second condition. The adjustment mechanism may contact the first tuft holder for adjusting the brush between the first condition and the second condition. The adjustment mechanism may be fixedly attached to the first tuft holder. The support structure may define an interior for receiving a portion of the adjustment mechanism. The brush may biased to remain in the first condition.

According to another embodiment of this invention, a method of adjusting a brush may include the steps of: (A) providing a first tuft holder including at least one tuft; (B) providing a second tuft holder including at least one tuft, wherein the second tuft holder is operatively attached to the first tuft holder; (C) providing a support structure including a handle to grasp and use the brush, wherein the first and second tuft holders are slidably attached to the support structure, and wherein the first and second tuft holders remain attached to the support structure throughout the entire method of adjusting the brush; (D) using an adjustment mechanism to adjust the brush between (1) a first condition where the first and second tuft holders are not movable with respect to each other; and, (2) a second condition where the first tuft holder is movable with respect to the second tuft holder. Step (D) may further include pushing on the adjustment mechanism to adjust the brush between the first condition and the second condition. The method may include the step of: (E) using the adjustment mechanism to adjust the brush between the second condition and the first condition. The method may include the step of: (E) releasing the adjustment mechanism to adjust the brush between the second condition and the first condition. The method may include the step of: (E) pulling on the adjustment mechanism to adjust the brush between the second condition and the first condition.

According to another embodiment of this invention, a brush may include: a first tuft holder including at least one tuft; a second tuft holder including at least one tuft; a brush tray, wherein the first and second tuft holders are operatively attached to the brush tray; and a support structure including an aperture, which receives a projection of the brush tray to secure the brush tray to the support structure, wherein the support structure includes a handle to grasp and use the brush; wherein the first and second tuft holders are movable with respect to each other when the brush tray is not secured to the support structure in a first condition, and wherein the first and second tuft holder are not movable with respect to each other when the brush tray is secured to the support structure in a second condition. The first tuft holder may include a groove and the brush tray may include a ridge, wherein the groove receives the ridge as the first tuft holder slides onto the brush tray, and wherein the ridge and groove coupling attaches the first tuft holder to the brush tray. The brush tray may include a side, which limits the sliding movement of the first and second tuft holders at an installed position. The projection of the brush tray may be removed from the aperture of the support structure to change the brush from the second condition to the first condition.

One advantage of this invention is that paint brushes can be easily cleaned. Another advantage of this invention is that replacement of only the brush portion of a paint brush is necessary when the useful life of the bristles is over.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

Figure 19A:
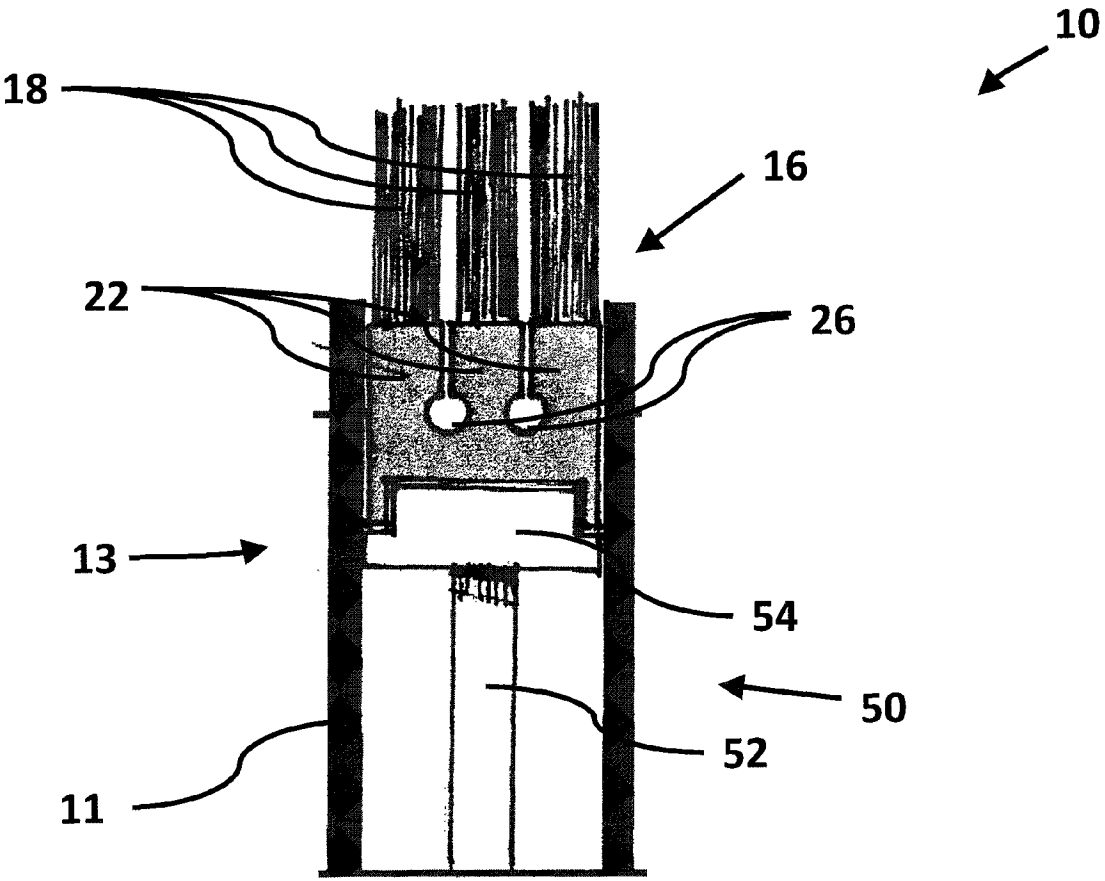

FIG. 19*a* is a partial cross-sectional side view of a paint brush according to another embodiment of this invention.

Figure 19B:
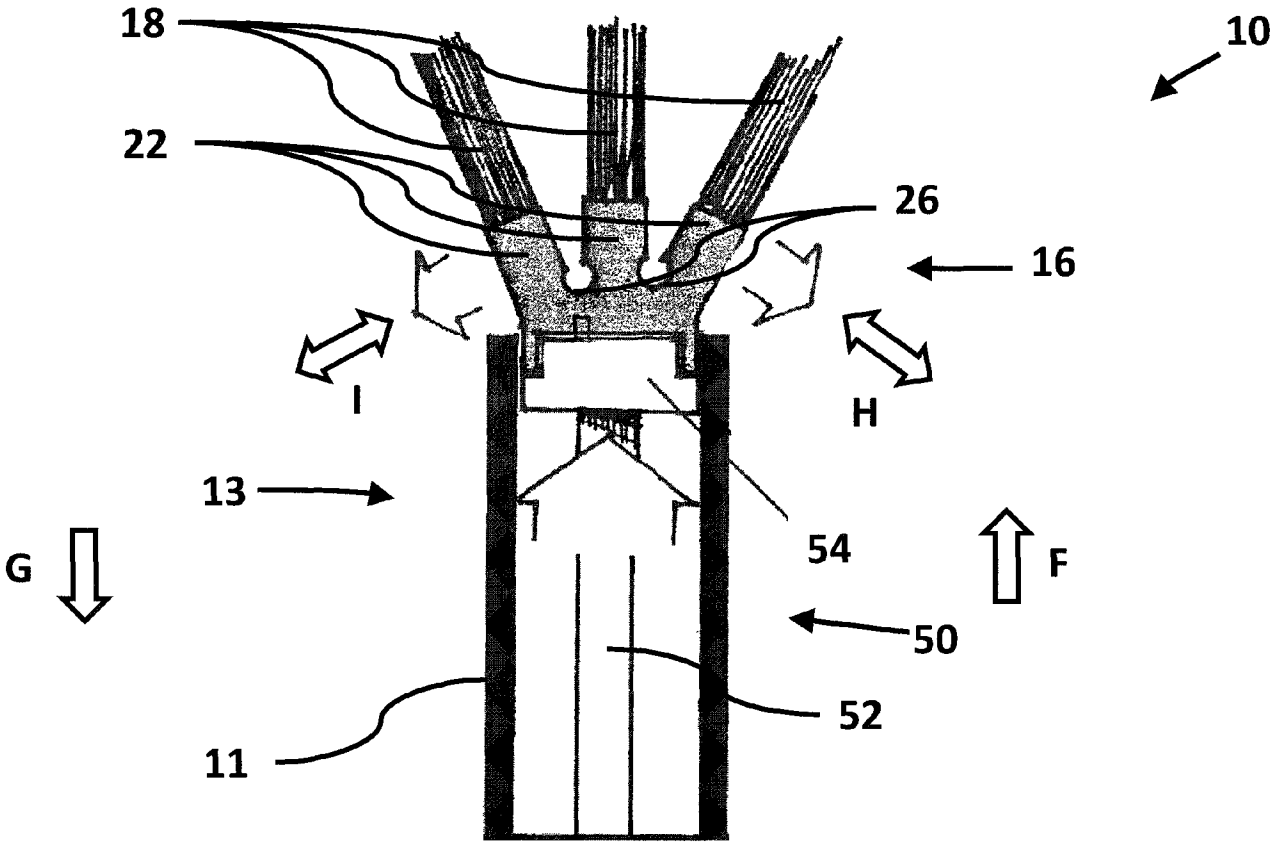

FIG. 19*b* is a partial cross-sectional side view of the paint brush shown in FIG. 19*a* demonstrating an embodiment of the non-use or cleaning condition.

Figure 20A:
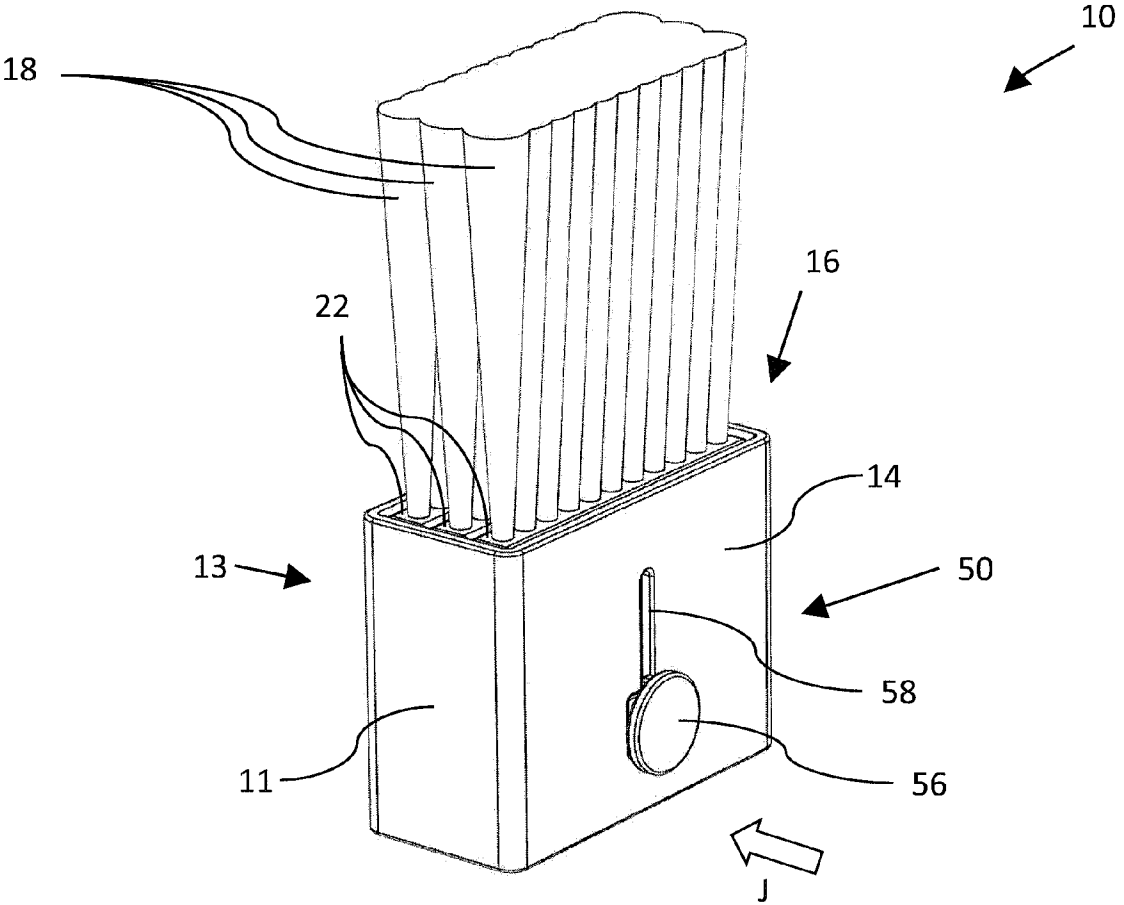

FIG. 20*a* is a perspective view of a paint brush according to another embodiment of this invention.

Figure 20B:
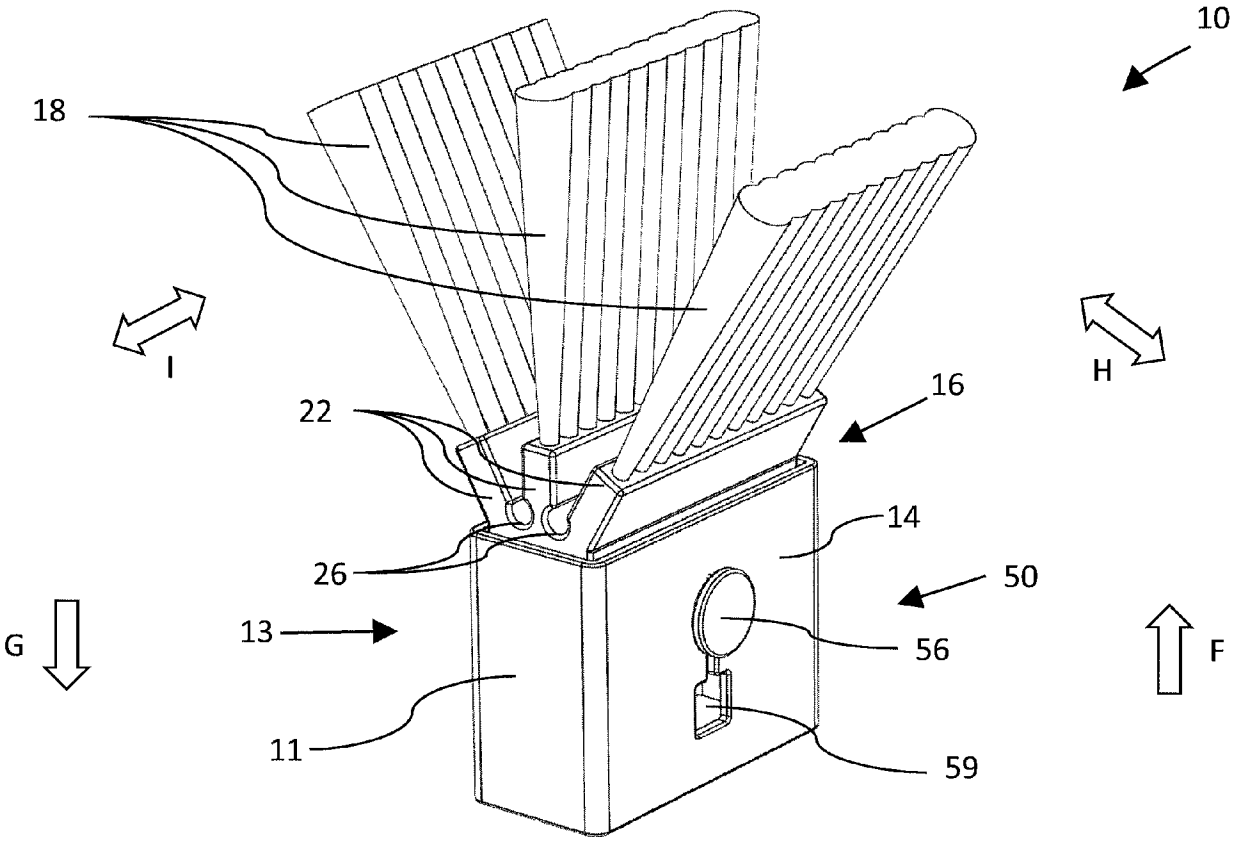

FIG. 20*b* is a perspective view of the paint brush shown in FIG. 20*a* demonstrating an embodiment of the non-use or cleaning condition.

Figure 21:
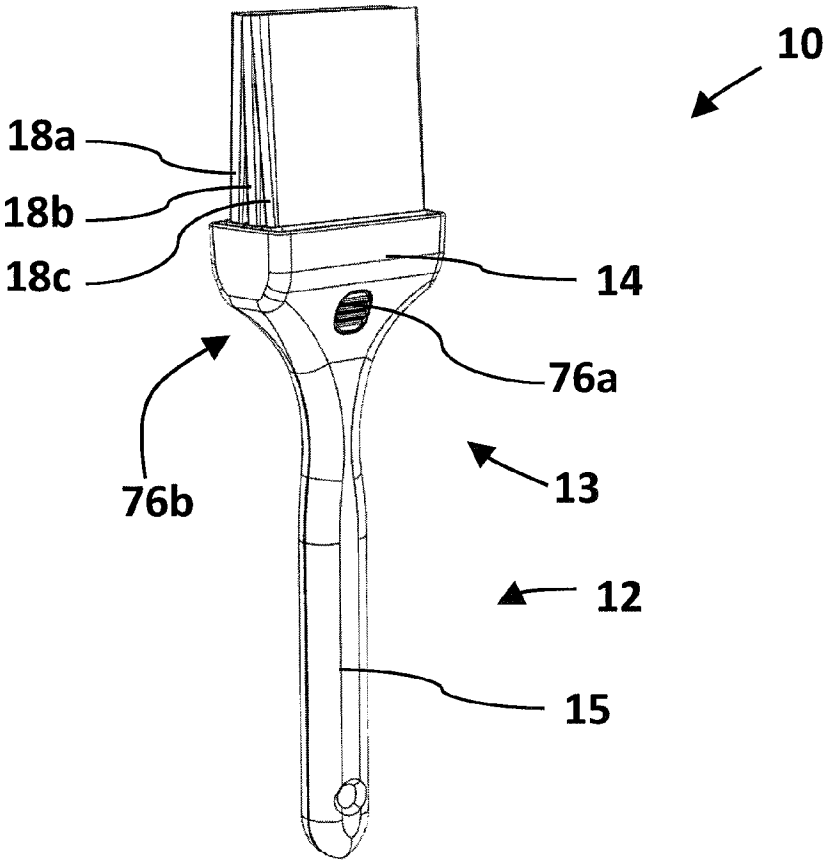

FIG. 21 is a perspective view of a paint brush according to another embodiment of this invention.

Figure 22:
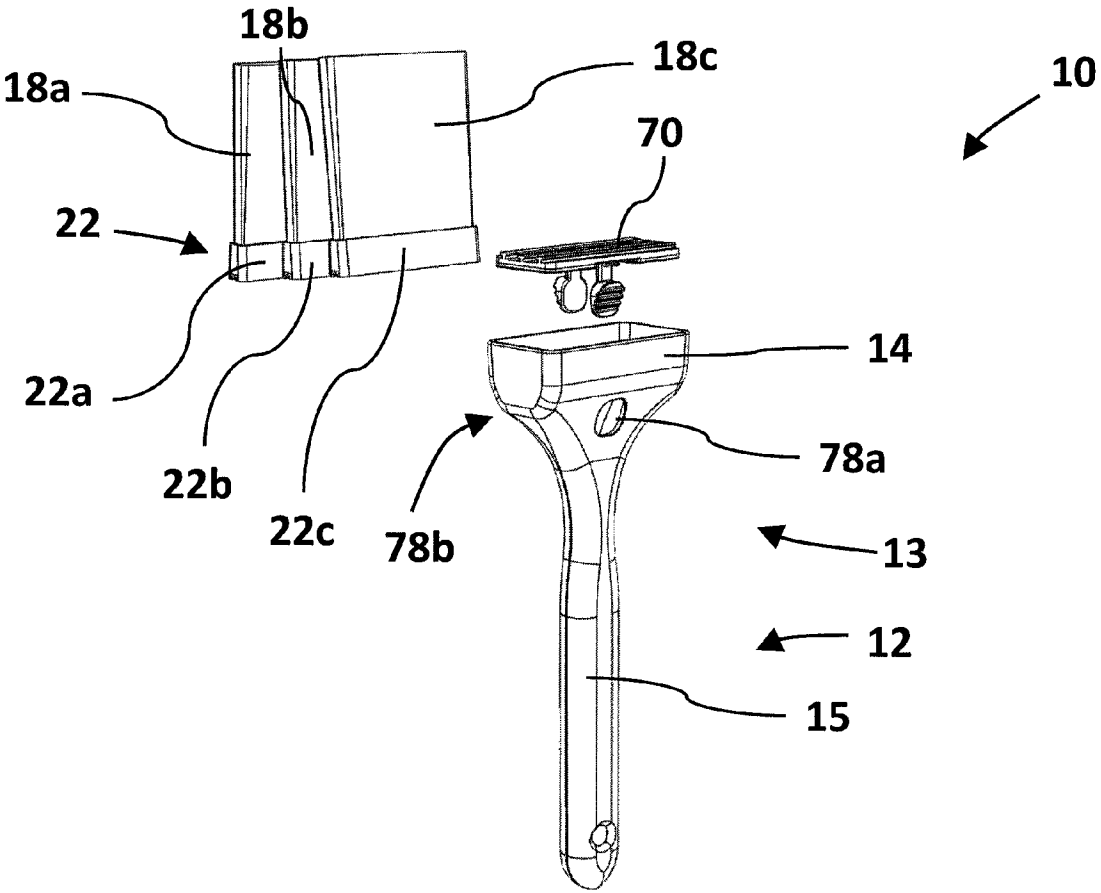

FIG. 22 is a perspective view of the paint brush shown in FIG. 21 demonstrating one embodiment of the non-use or cleaning condition.

Figure 23:
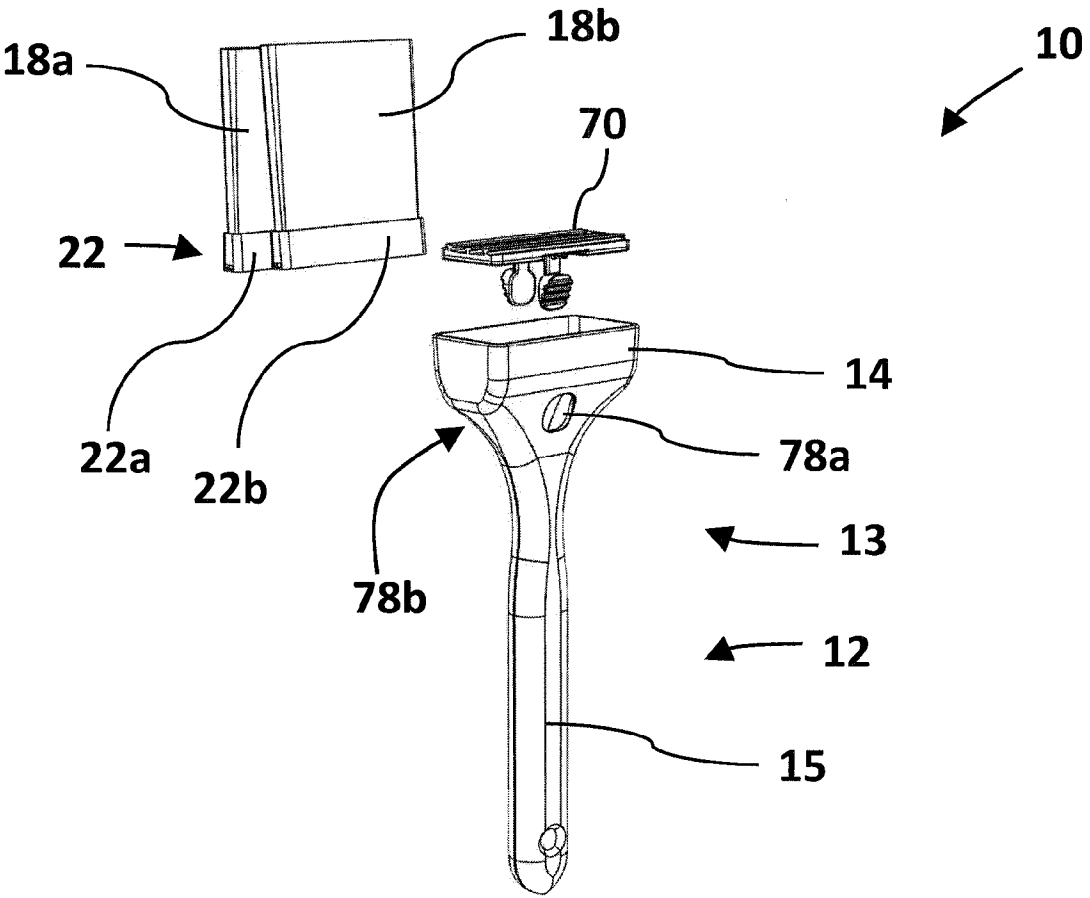

FIG. 23 is a perspective view of the paint brush shown in FIG. 21 demonstrating one embodiment of the non-use or cleaning condition.

Figure 24A:
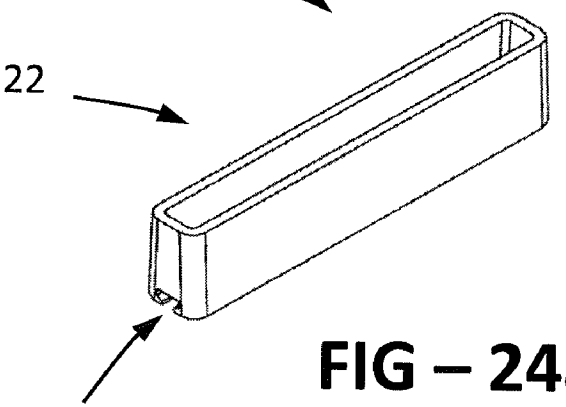

FIG. 24*a* shows a perspective view of a tuft holder, according to the embodiment shown in FIG. 21.

Figure 24B:
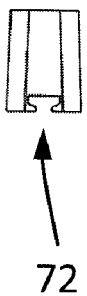

FIG. 24*b* shows a side view of the tuft holder shown in FIG. 24*a*.

Figure 24C:
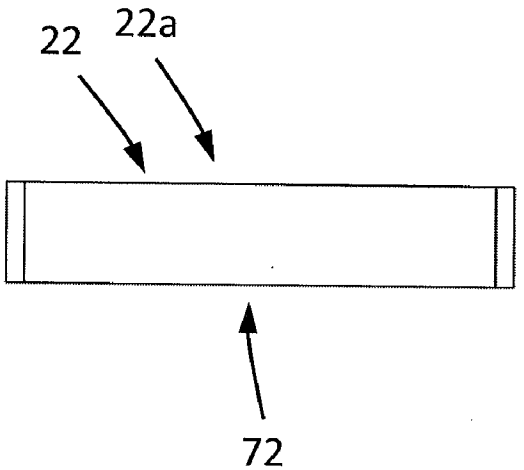

FIG. 24*c* shows a front view of the tuft holder shown in FIG. 24*a*.

Figure 24D:
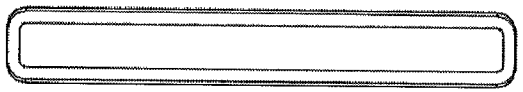

FIG. 24*d* shows a top view of the tuft holder shown in FIG. 24*a*.

Figure 25A:
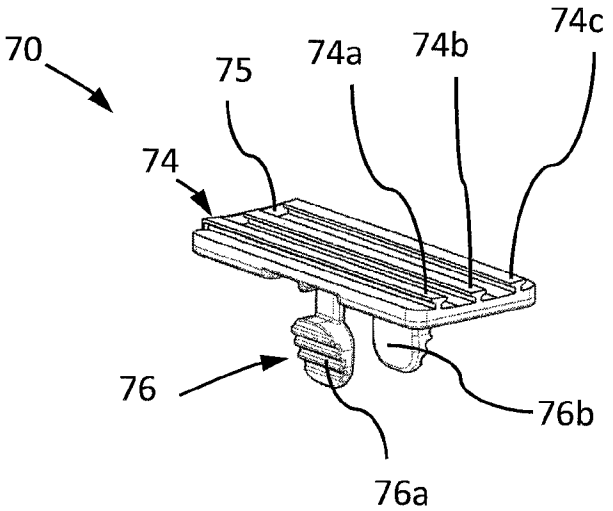

FIG. 25*a* shows a perspective view of a brush tray, according to the embodiment shown in FIG. 21.

Figure 25B:
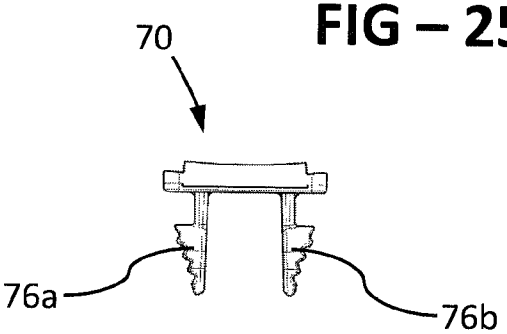

FIG. 25*b* shows a side view of the brush tray shown in FIG. 25*a*.

Figure 25C:
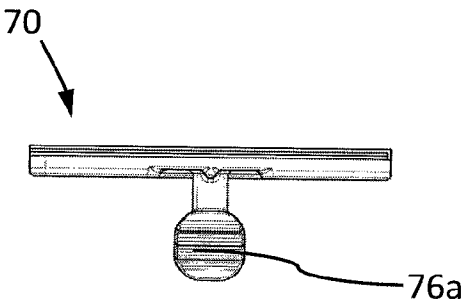

FIG. 25*c* shows a front view of the brush tray shown in FIG. 25*a*.

Figure 25D:
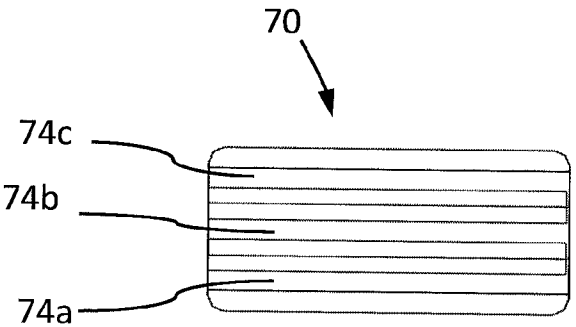

FIG. 25*d* shows a top view of the brush tray shown in FIG. 25*a*.

Figure 26A:
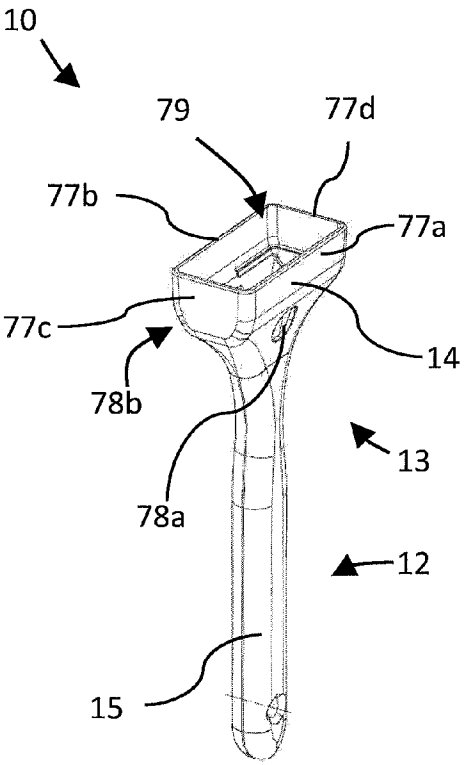

FIG. 26*a* shows a perspective view of a brush handle, according to the embodiment shown in FIG. 21.

Figure 26B:
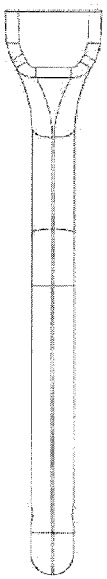

FIG. 26*b* shows a side view of a brush handle shown in FIG. 26*a*.

Figure 26D:
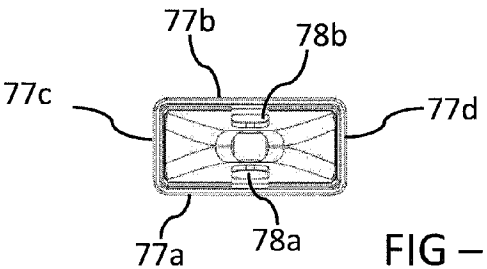
Figure 26C:
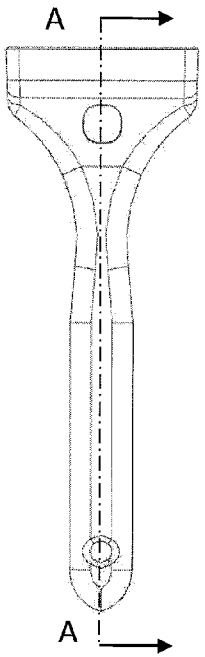

FIG. 26*c* shows a front view of the brush handle shown in FIG. 26*a*.

FIG. 26*d* shows a top view of the brush handle shown in FIG. 26*a*.

Figure 26E:
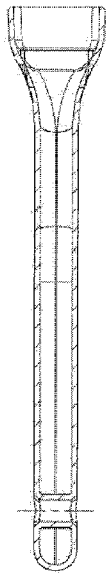

FIG. 26*e* shows a section A-A view of the brush handle shown in FIG. 26*c*.

Figures 27A, 27B, 27C, 27D, 27E:
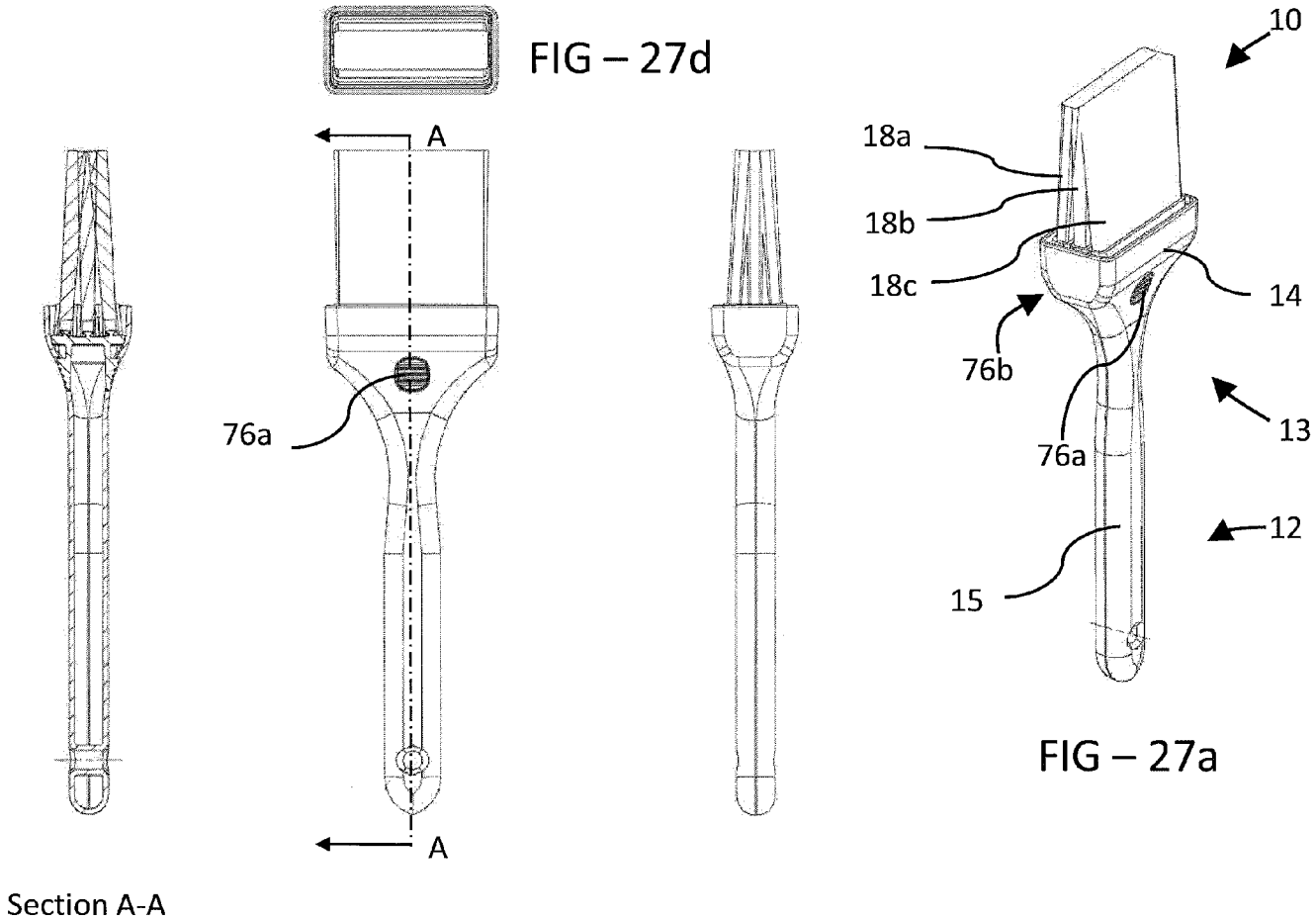

FIG. 27*a* shows a perspective view of a paint brush, according to the embodiment shown in FIG. 21.

FIG. 27*b* shows a side view of the paint brush shown in FIG. 27*a*.

FIG. 27*c* shows a front view of the paint brush shown in FIG. 27*a*.

FIG. 27*d* shows a top view of the paint brush shown in FIG. 27*a*.

FIG. 27*e* shows a section A-A view of the paint brush shown in FIG. 27*c*.

IV. DETAILED DESCRIPTION OF THE INVENTION

Figure 5:
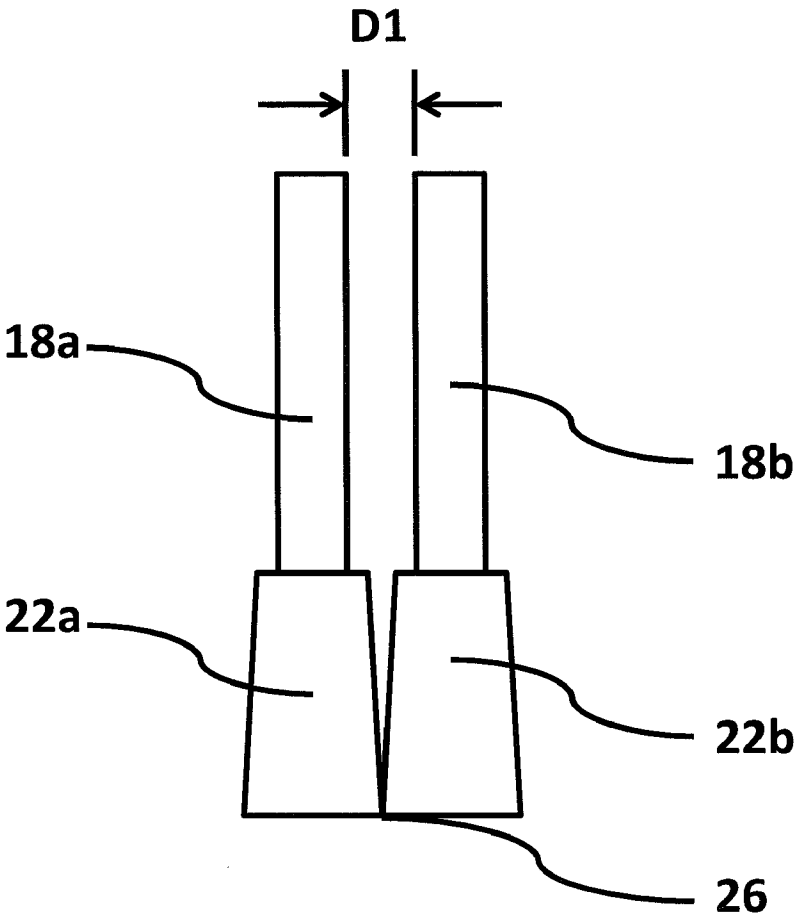
FIG. 5 is a schematic view of tuft holders demonstrating the distance D1 between the tufts in the non-use or cleaning condition.
Figure 6:
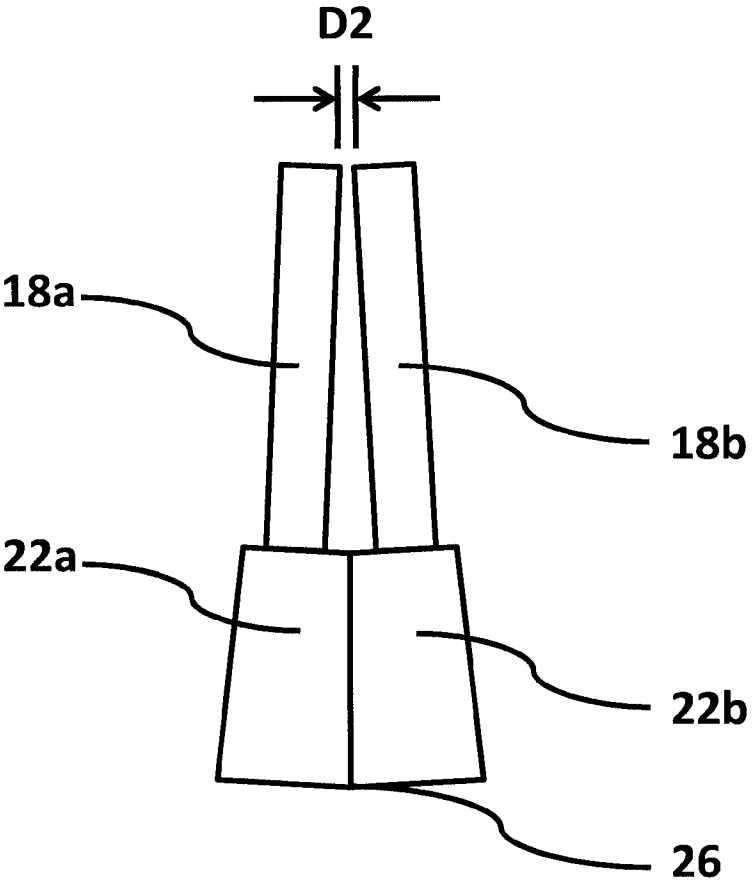
FIG. 6 is a schematic view of tuft holders demonstrating the distance D2 between the tufts in the use condition.
Figure 7:
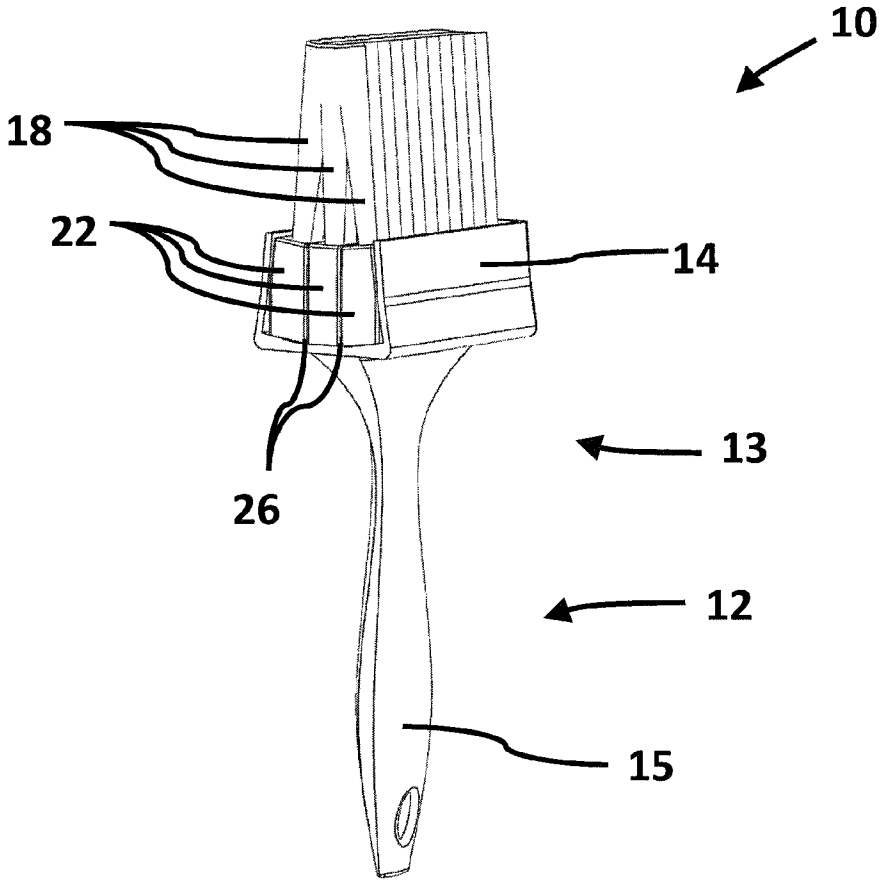
FIG. 7 is a perspective view of a paint brush according to another embodiment of this invention.
Figure 8:
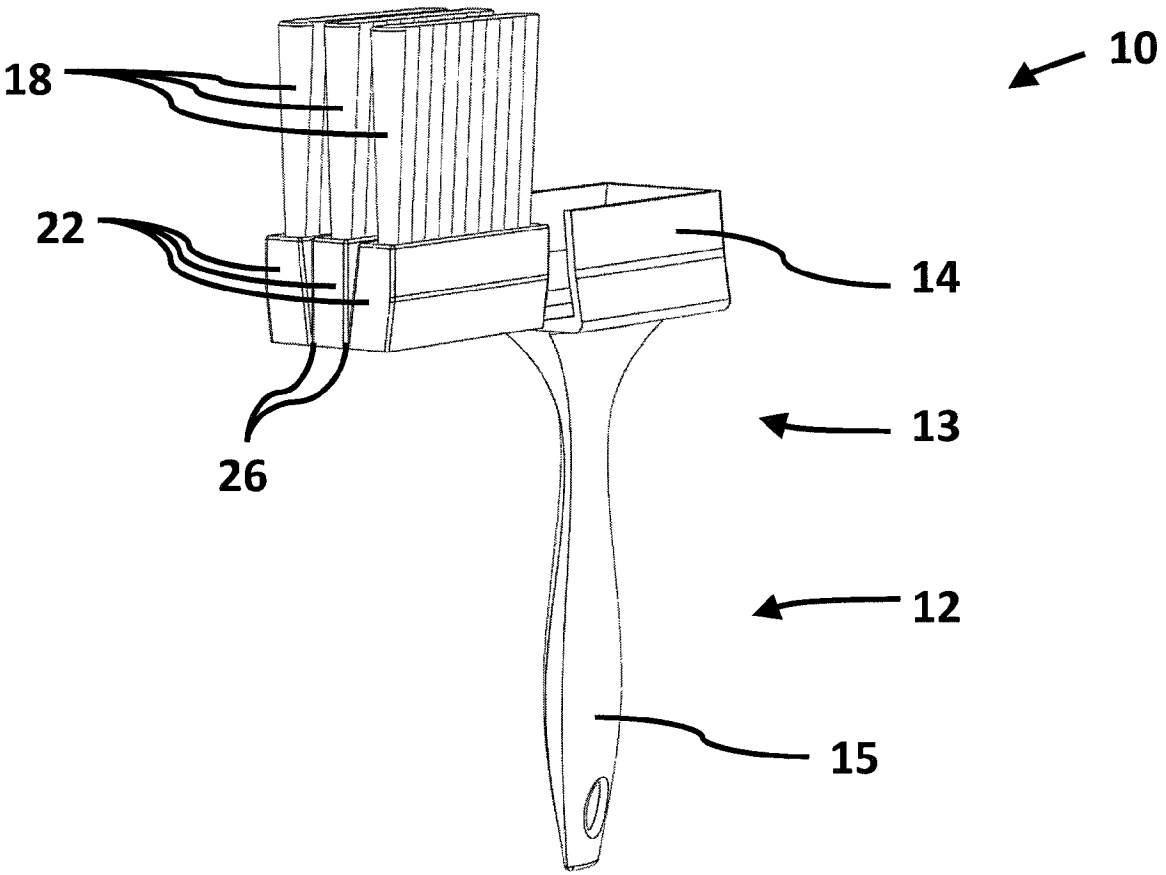
FIG. 8 is a perspective view of the paint brush in FIG. 7 demonstrating one embodiment of the first condition.

Referring now to the drawings wherein the showings are for purposes of illustrating embodiments of the invention only and not for purposes of limiting the same, and wherein like reference numerals are understood to refer to like components, FIGS. 1-4 show a brush 10 equipped with one embodiment of this invention. While the invention is disclosed with application to a paint brush, it is to be understood that this invention will work with any brush chosen with the sound judgment of a person of skill in the art. The brush 10 may include at least two tuft holders 22*a*, 22*b* (a third tuft holder 22*c* also shown), each of which holds at least one tuft 18*a*, 18*b*, respectively and a support structure 13 that supports the tuft holders 22*a*, 22*b* (and thereby the tufts 18*a*, 18*b*) and by which a user can use the tufts 18*a*, 18*b*. The brush 10 of this invention may be adjustable between: (1) a first condition, shown in FIGS. 2 and 3, where at least one tuft holder 22*a* is movable with respect to another tuft holder 22*b* and, (2) a second condition, shown in FIG. 1, where the tuft holders 22*a*, 22*b* are not movable with respect to each other. When in the first condition, the tuft holders 22*a*, 22*b* may be easily moved relative to each other to increase the distance between the two tufts 18*a*, 18*b*. Note distance D1 shown in FIG. 5. This relatively larger distance D1 between tufts 18*a*, 18*b* is beneficial for cleaning the tufts 18*a*, 18*b*. When in the second condition, the tufts 18*a*, 18*b* may be secured in positioned relatively near each other. Note distance D2 shown in FIG. 6. This relatively smaller distance D2 between tufts 18*a*, 18*b* is beneficial for using the tufts 18*a*, 18*b*, such as for painting. The support structure 13 may include a tuft holder attachment device 14 by which the tuft holders 22*a*, 22*b*, 22*c* may be attached to the support structure 13. The operation of the tuft holder attachment device 14 will be discussed further below. The support structure 13 may also include a grip surface 15 that may be gripped by a user to use the brush 10. In one embodiment, the grip surface 15 is formed on a handle 12 that extends from the tuft holder attachment device 14. The handle 12 may have any shape chosen for ergonomics and/or aesthetics. In another embodiment, a separate handle 12 is not required and the outer surface of the tuft holder attachment device 14 can be used as the grip surface 15.

Figure 3:
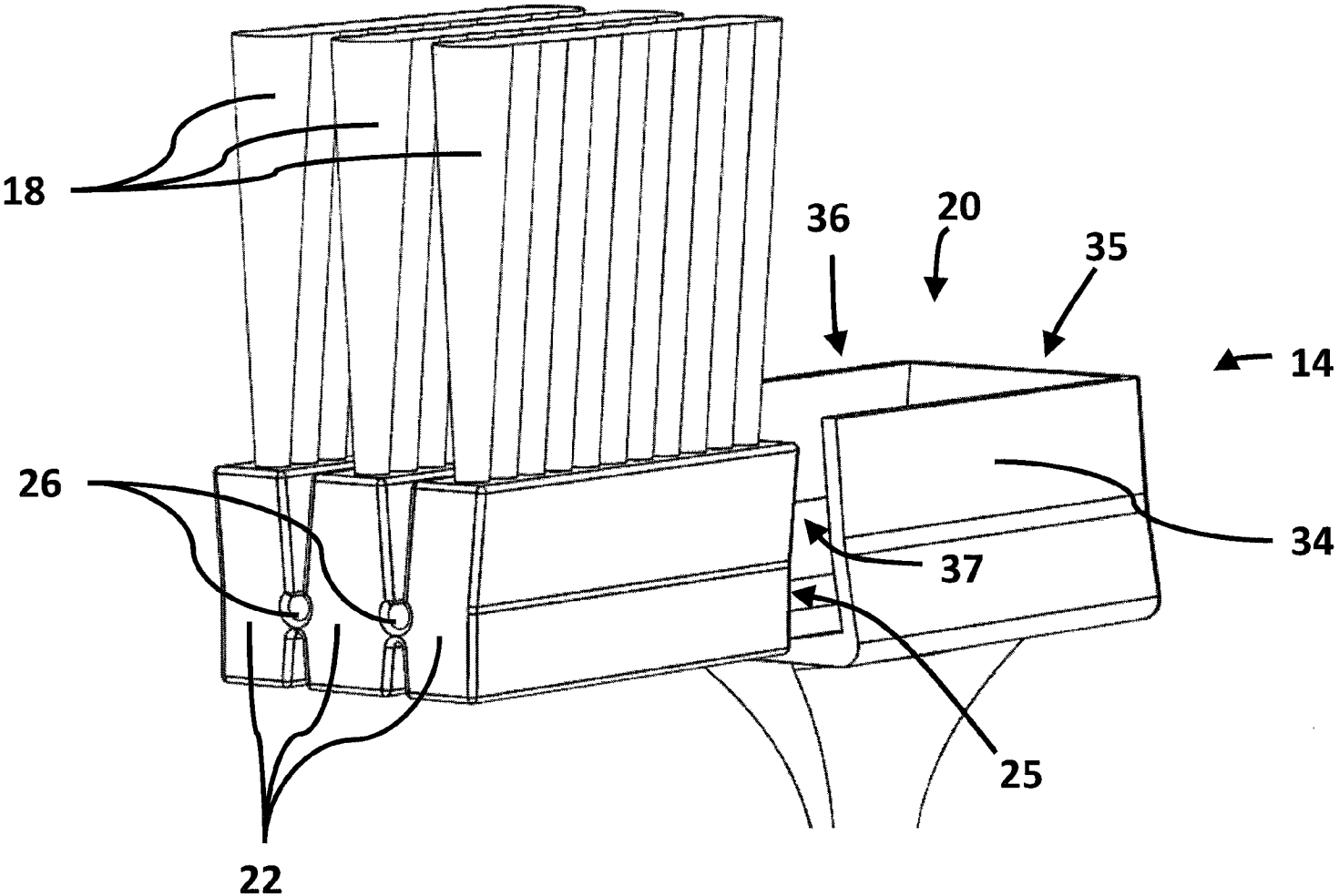
FIG. 3 is a close up view of the tuft holder attachment device of the paint brush shown in FIG. 2.
Figure 4:
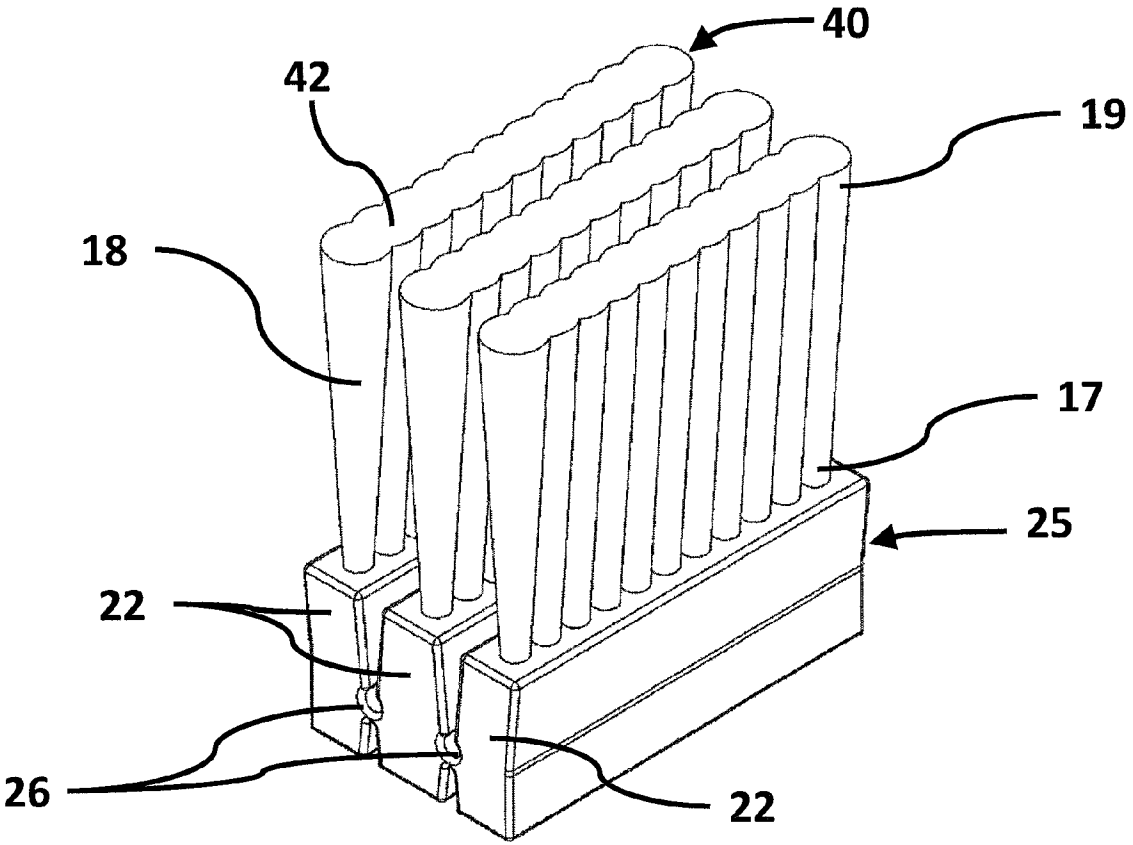
FIG. 4 is a close up view of tuft holders according to one embodiment of this invention.

With reference now to all FIGURES, throughout this patent the term "tuft" is to be understood to mean the combination of one or more bristles or filaments that together work as a unit. In one non-limiting embodiment, a bundle of filaments 18 is attached to a fixture 22 with epoxy. FIGS. 3 and 4, for example, shows three rows of tufts 18 with eleven tufts 18 in each row. The specific number of bristles or filaments used to make up one tuft 18 can be any number chosen by one skilled in the art. The bristles or filaments may be made from a variety of natural materials or fibers or from synthetic materials including, for non-limiting examples, nylon, and/or polyester. Each tuft 18 may have, as shown in FIG. 4, a proximal end 17, nearest the tuft holder 22, and a distal end 19, farthest from the tuft holder 22. The proximal end 17 of each tuft 18 may be attached or fastened to a tuft holder 22 in any manner chosen by one skilled in the art. In one embodiment, the proximal end 17 of each tuft 18 is inserted within a tuft receptacle 28, referenced in FIGS. 12, 13, 15 and 16, and the distal end 19 is exposed and available for use. In another embodiment, two tufts 18, 18 may be made from a single combination of one or more bristles or filaments. In this case, a mid-portion of the combination of bristles may be connected to the tuft holder 22 and the opposite ends may define the two distal ends 19, 19 of the two tufts 18, 18. This connection can be accomplished using a staple, a wire, a screw, adhesive or any other fastening means chosen by one skilled in the art. The number and orientation of tufts 18 attached to a tuft holder 22 can be any chosen with the sound judgment of a person of skill in the art.

The number, and orientation of tuft holders 22 can also be any chosen with the sound judgment of a person of skill in the art. In some embodiments, two tuft holders 22, 22 are used, as shown in FIGS. 5, 6, 12-18, and 23. In some embodiments, three tuft holders 22, 22, 22 are used, as shown in FIGS. 1-4, 7-11, 19-22, and 27. The specific design of the tuft holders 22 can also be any chosen with the sound judgment of a person of skill in the art. Thus, in one embodiment the tuft holders 22 may be identical or nearly identical while in another embodiment the tuft holders 22 may be substantially different. While the tuft holders shown are substantially rectangular in shape, it is to be understood that a rectangular shape is exemplary only. In one embodiment, shown in FIGS. 12-14, the tuft holders 22*a*, 22*b* may have alternating ridges 30 and grooves 32. Each tuft holder 22 may have any number of tuft receptacles 28 chosen by one skilled in the art. The tuft receptacles 28 can be arranged on the tuft holder 22 in any manner including rows, columns, or in a staggered arrangement. Tuft receptacles 28 can be angled towards each other in the second condition.

Figure 14:
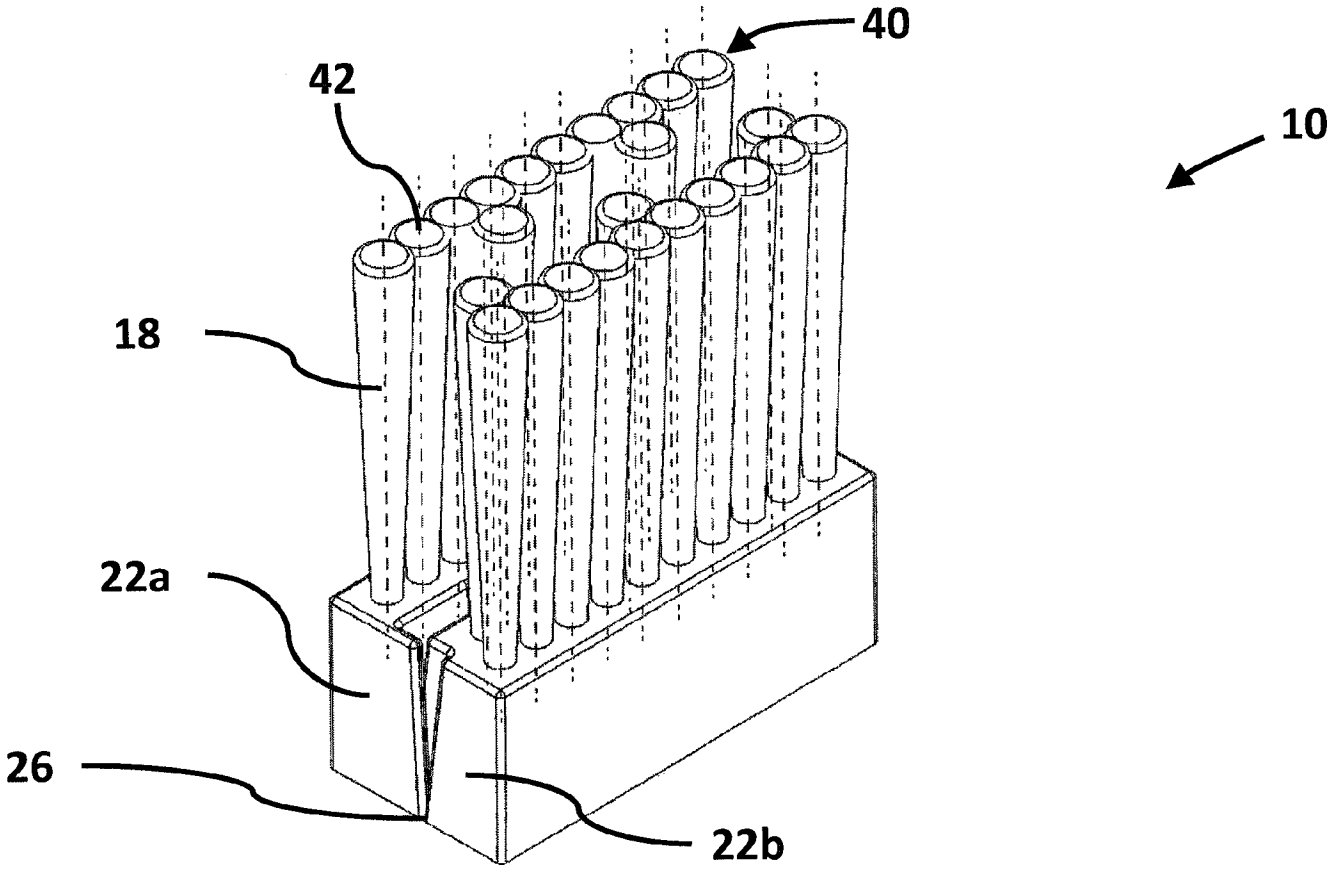
FIG. 14 is a close up view of tuft holders according to yet another embodiment of this invention.
Figure 15:
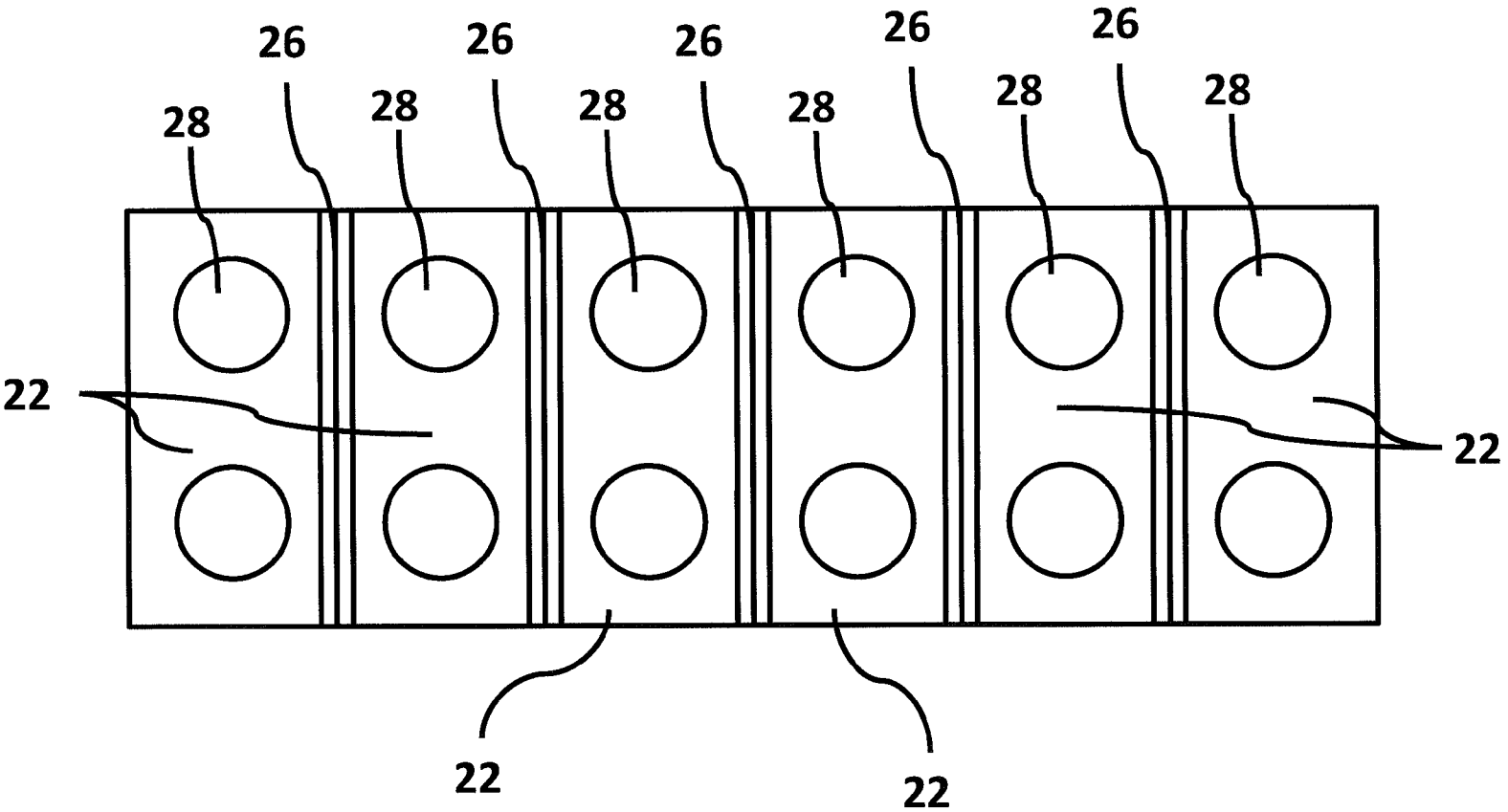
FIG. 15 is a top view of tuft holders according to yet another embodiment of this invention.
Figure 16:
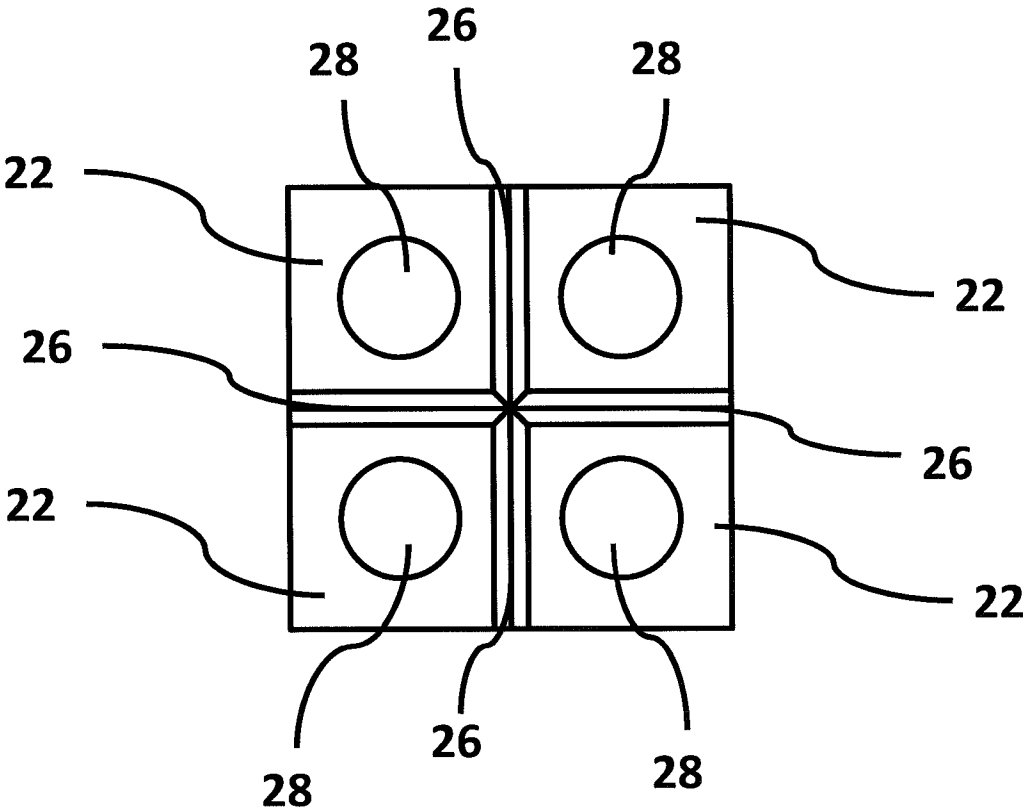
FIG. 16 is a top view of tuft holders according to still another embodiment of this invention.

The tuft holders 22 used in a brush 10 may be designed in any manner chosen with the sound judgment of a person of skill in the art to provide for relative motion. In some embodiments, a hinge 26 may be used, as shown in FIGS. 1-10, 12-16, 19, and 20. The particular type of hinge 26 used can be of any type chosen with the sound judgment of a person of skill in the art. The hinge 26, for example, may be of the type known as a living hinge. In alternate embodiments, the hinge 26 may be any type of butt hinge, continuous or piano hinge, flush hinge, butterfly hinge, barrel hinge, or any other type of hinge chosen by one skilled in the art. In further embodiments, the hinge 26 may be formed from the same material as the tuft holder 22 or may be formed from a different material. In one embodiment, the tuft holders 22 and corresponding hinge 26 may be formed in the same mold. The particular location of the hinge 26 with respect to the tuft holders 22 can also be any chosen by one skilled in the art. In one embodiment, the tuft holders 22 may be operatively connected by hinges 26 positioned in the transverse direction, as shown in FIG. 15, as opposed to other embodiments where the hinges 26 were positioned in the longitudinal direction. In another embodiment, each tuft holder may be operatively connected to hinges 26 in both the longitudinal and transverse directions, as shown in FIG. 16.

Figure 17:
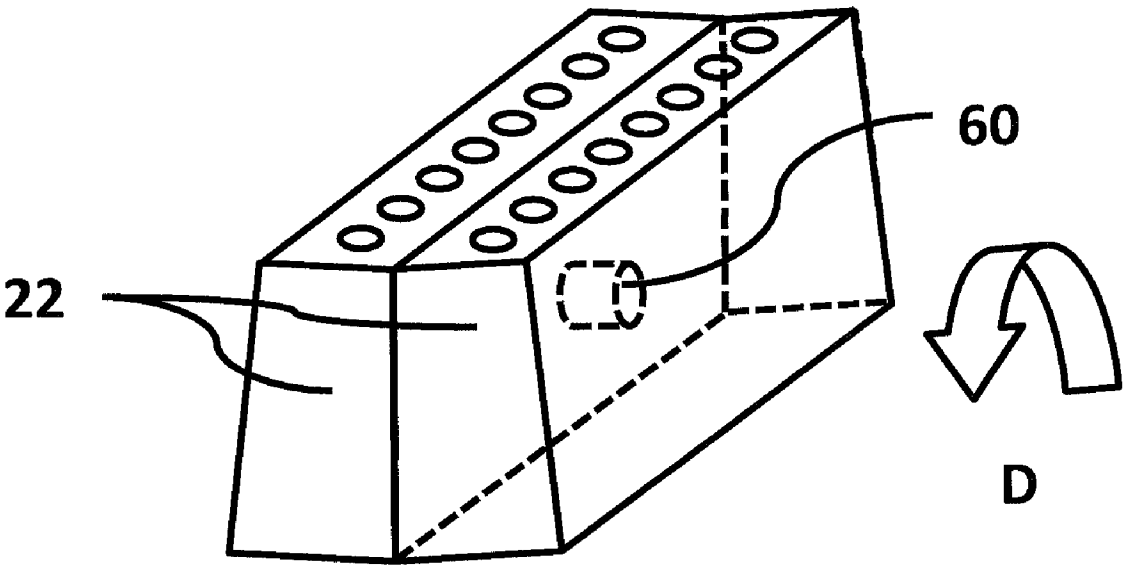
FIG. 17 is a schematic view of tuft holders joined by a pivot shaft according to one embodiment of this invention.
Figure 18:
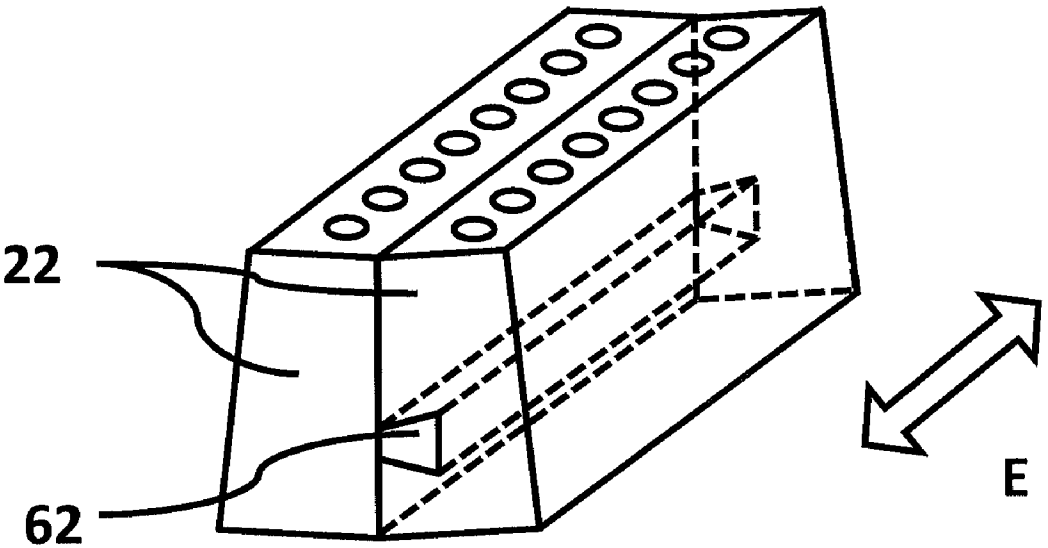
FIG. 18 is a schematic view of tuft holders joined by a tongue and groove mechanism according to one embodiment of this invention.

The tuft holders 22 may be pivotal with respect to each other. In one embodiment, a pivot shaft or pin 60 may be used to provide relative pivotal motion between tuft holders 22 in direction D, as shown in FIG. 17. Tuft holders 22 may also be operatively connected by a tongue and groove mechanism 62, as shown in FIG. 18. In this embodiment, one tuft holder 22 can slide with respect to the other tuft holder 22 in direction E, also shown in FIG. 18.

With reference now to FIGS. 21-27, a brush 10 may include a handle 12, a support structure 13, a brush tray 70, and a bristle tray or tuft holder 22. It is to be understood that the dimensions shown are exemplary only all dimensions can be varied in accordance with the sound judgment of a person of skill in the art. The brush 10, the handle 12, the support structure 13, the brush tray 70, and the bristle tray or tuft holder 22 can be made of plastic or any other material chosen by one skilled in the art. The brush handle 12 may include a grip surface 15, which may be gripped by a user to use the brush 10. The support structure 13 may include a tuft holder attachment device 14, which receives the brush tray 70. The attachment device 14 may include walls or sides 77*a*, 77*b*, 77*c*, 77*d*, and an opening 79 to receive the brush tray 70, as shown in FIG. 26. (In comparison with the embodiment shown in FIG. 3, in which the attachment device 14 has three walls or sides 34, 35, 36.) The brush 10 may include any number of bristle trays or tuft holders 22*a*. In one embodiment, the brush 10 includes two bristle trays or tuft holders 22*a*, 22*b*, as shown in FIG. 23. In another embodiment, the brush 10 includes three bristle trays or tuft holders 22*a*, 22*b*, 22*c* as shown in FIG. 22. Each of the tuft holders 22*a*, 22*b*, 22*c* may include a corresponding tuft 18*a*, 18*b*, 18*c*. The tuft holder 22*a* may include a groove or channel 72 having any shape chosen with ordinary skill in the art. In one embodiment, the groove 72 has a general T-shape, as shown in FIG. 24. The brush tray 70 may include a ridge 74, which is sized to fit into the groove 72. In one embodiment, the ridge 74 has a general T-shape, as shown in FIG. 25. Each of the tuft holders 22*a*, 22*b*, 22*c* can independently slide onto and off of the brush tray 70, with the ridges 74*a*, 74*b*, 74*c* on the brush tray 70 sliding into the groove 72 in each of the tuft holders 22*a*, 22*b*, 22*c*. The brush tray 70 may also include a wall or side 75 at one end of the ridges 74*a*, 74*b*, 74*c* to limit the sliding movement of the tuft holders 22*a*, 22*b*, 22*c* as they are installed on the brush tray 70. When the tuft holder 22 makes contact with the side 75, the tuft holder 22 is in an installed position or condition. The brush tray 70 may include a projection or protrusion 76 to connect the brush tray 70 to the attachment device 14. The projection 76 can be resilient or elastic. An aperture 78*a* in the attachment device 14 may receive the projection 76 and secure the brush tray 70 to the attachment device 14. In one embodiment, the brush tray 70 includes two projections 76*a*, 76*b* and the attachment device 14 includes two corresponding apertures 78*a*, 78*b* for receiving the projections 76*a*, 76*b*, and thus securing the brush tray 70 to the attachment device 14. In a more specific embodiment, the attachment device 14 includes apertures 78*a*, 78*b* in the corresponding walls 77*a*, 77*b*, as shown in FIG. 26.

Figure 1:
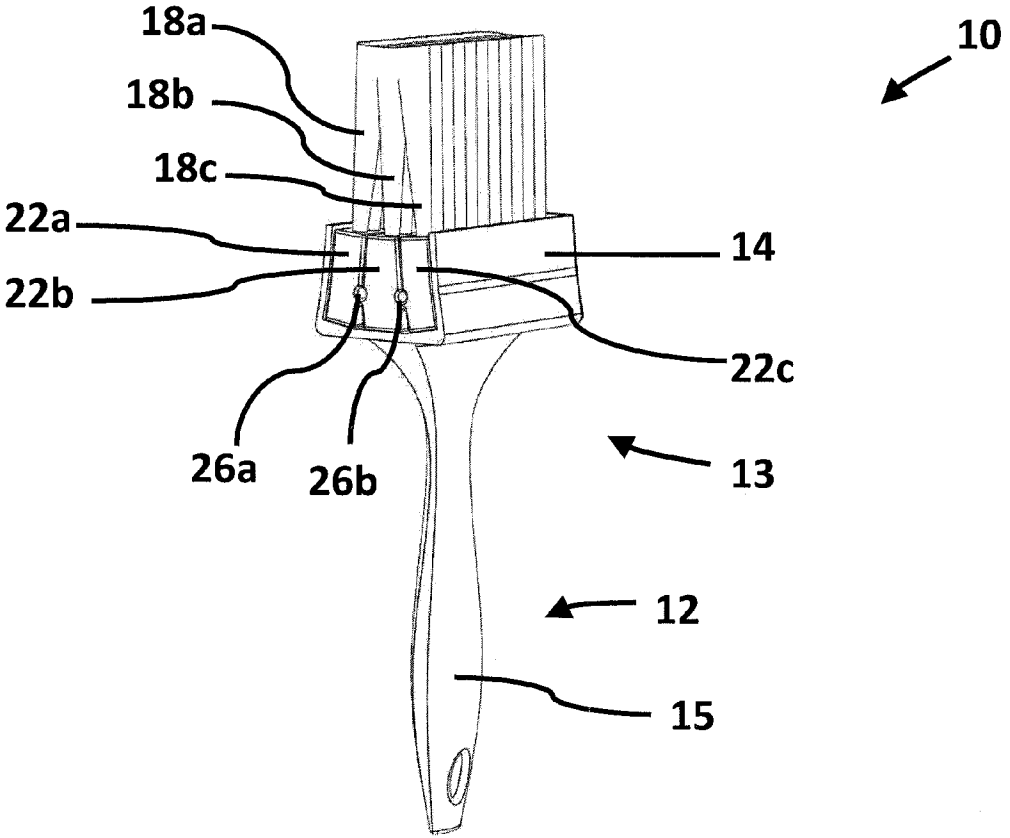
FIG. 1 is a perspective view of a paint brush according to one embodiment of this invention.
Figure 2:
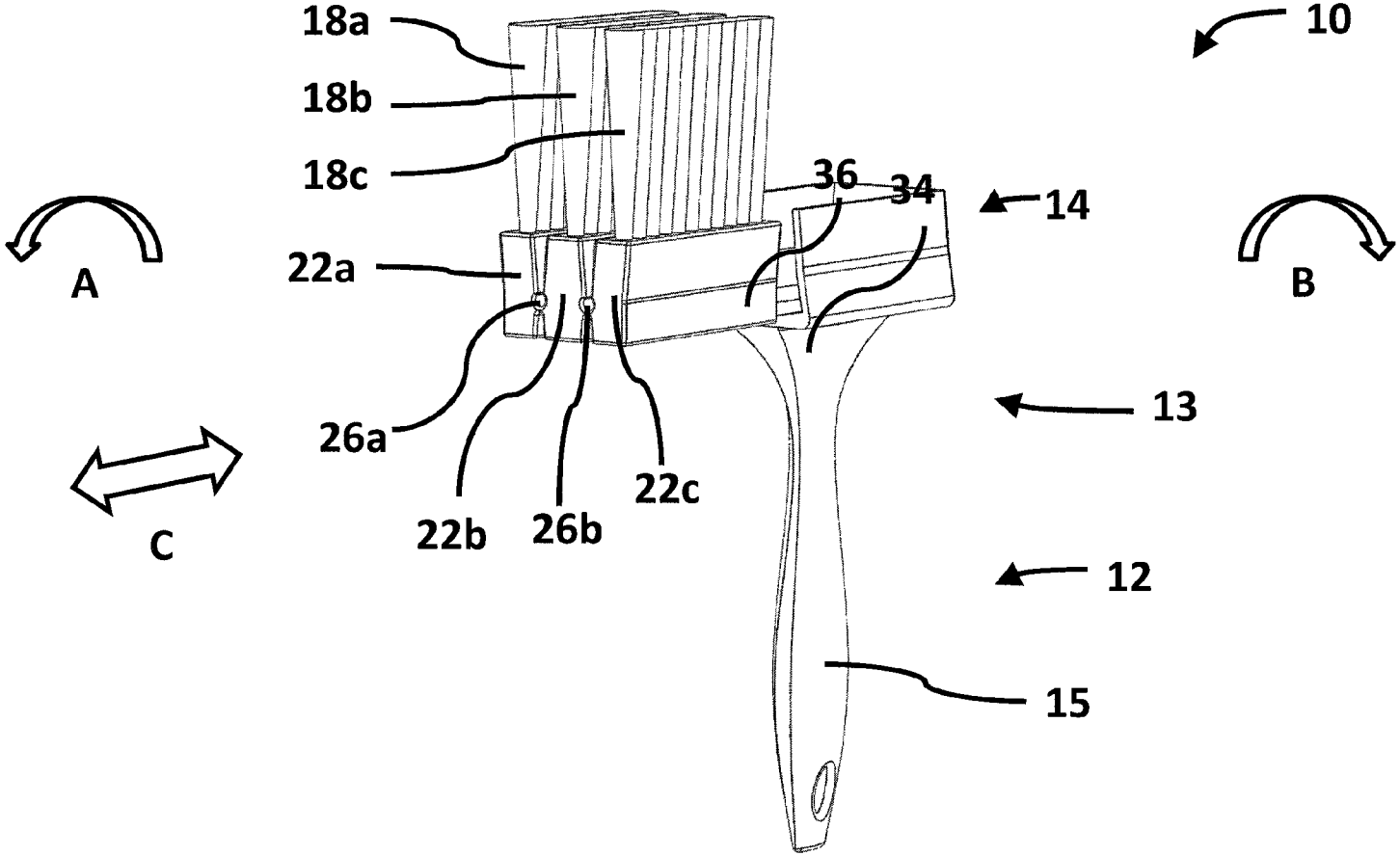
FIG. 2 is a perspective view of the paint brush in FIG. 1 demonstrating one embodiment of the non-use or cleaning condition.

The operation of the brush 10 shown in FIGS. 1-4 will now be described. The first condition, where at least one tuft holder 22*a* is movable with respect to another tuft holder 22*b*, is shown in FIGS. 2-3. In this case, because the tuft holders 22*a*, 22*b*, 22*c* have been removed from the tuft holder attachment device 14 in direction C, they can easily be pivoted to increase the distance between the tufts 18*a*, 18*b*, 18*c*. Depending on the strength of the hinges 26*a* and 26*b*, and the weight of the tufts 18*a*, 18*b*, 18*c*, this pivot motion may occur automatically under the force of gravity or may require a manual, but relatively slight force from the user. More specifically outer tuft holder 22*a* may pivot with respect to middle tuft holder 22*b* in direction A about hinge 26*a* and similarly outer tuft holder 22*c* may pivot with respect to middle tuft holder 22*b* in direction B about hinge 26*b*. To place the brush 10 into the second condition, where the tuft holders 22*a*, 22*b* are not movable with respect to each other, it is only necessary to pivot the tuft holders 22*a*, 22*b*, 22*c* to decrease the distance between the tufts 18*a*, 18*b*, 18*c* and then position the tuft holders 22*a*, 22*b*, 22*c* into the tuft holder attachment device 14 in direction C. In this embodiment, two outer walls 34, 36 of the tuft holder attachment device 14 are fixed and have inner surfaces that contact the outer surfaces of the outer tuft holders 22*a*, 22*c* to prevent the pivotal motion of the tuft holders 22*a*, 22*b*, 22*c*. The specific orientation of the walls 34, 36 may vary depending on design needs. For the embodiment shown, the tops of the walls 34, 36 are angled inwardly to maintain the tufts 18*a*, 18*b*, 18*c* at an angle whereby the distal ends 19 are very close together. A third outer wall 35 may serve as a stop or limiting boundary that is contacted by the end 25 of the tuft holders 22*a*, 22*b*, 22*c* as they are positioned into the tuft holder attachment device 14. Note that the fourth side 37 of the tuft holder attachment device 14 does not have a wall. In this way, there is an opening into which the tuft holders 22*a*, 22*b*, 22*c* can be positioned. In another embodiment, not shown, any of the tuft holder attachment device 14 walls 34, 35, 36 can be adjusted between a position where they serve as contacts or limits for the tuft holders 22*a*, 22*b*, 22*c* (such as walls 34, 35, 36) and a position where they do not serve as contacts or limits (such as the fourth side 37).

Figure 9:
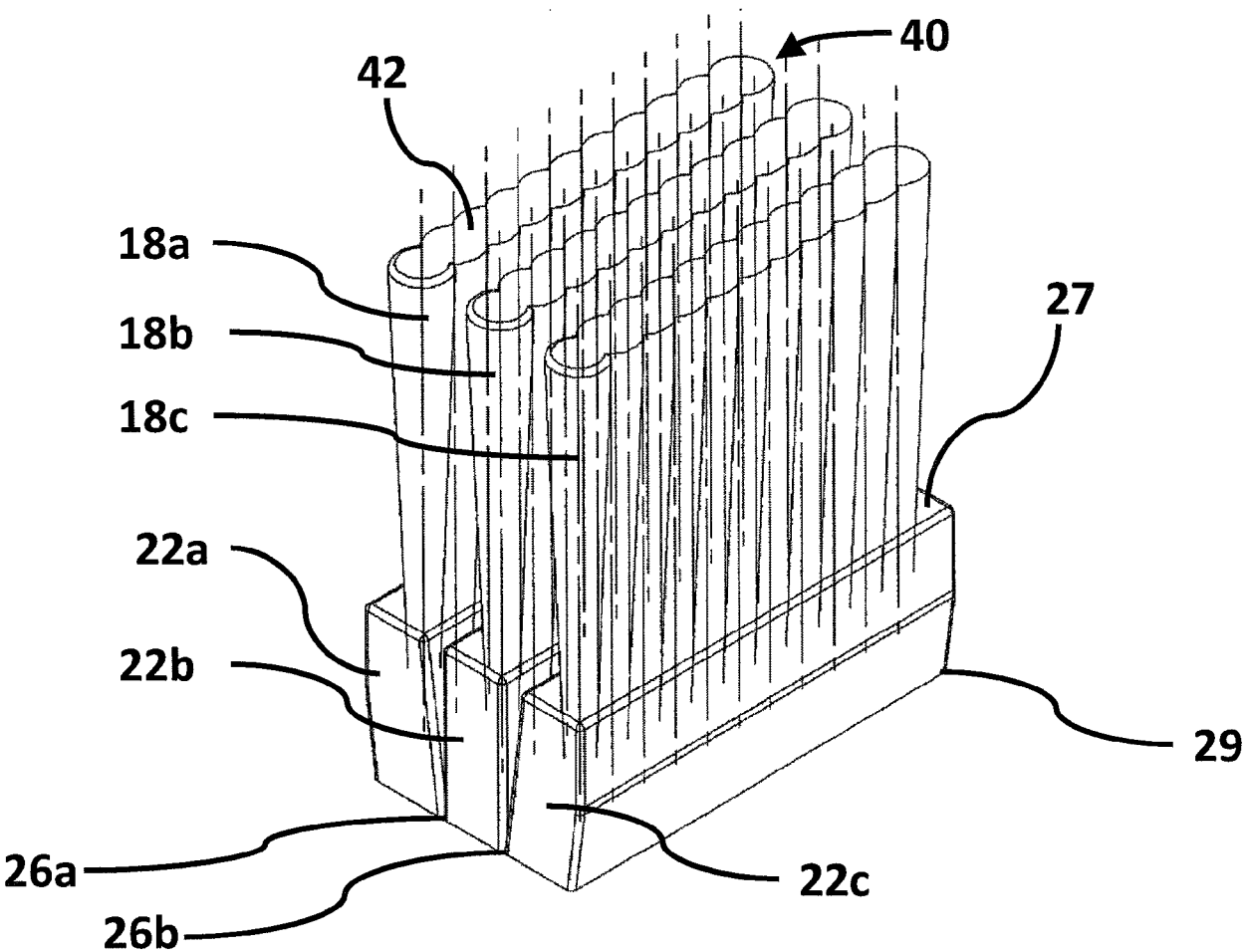
FIG. 9 is a close up view of a tuft holder according to one embodiment of this invention.
Figure 10:
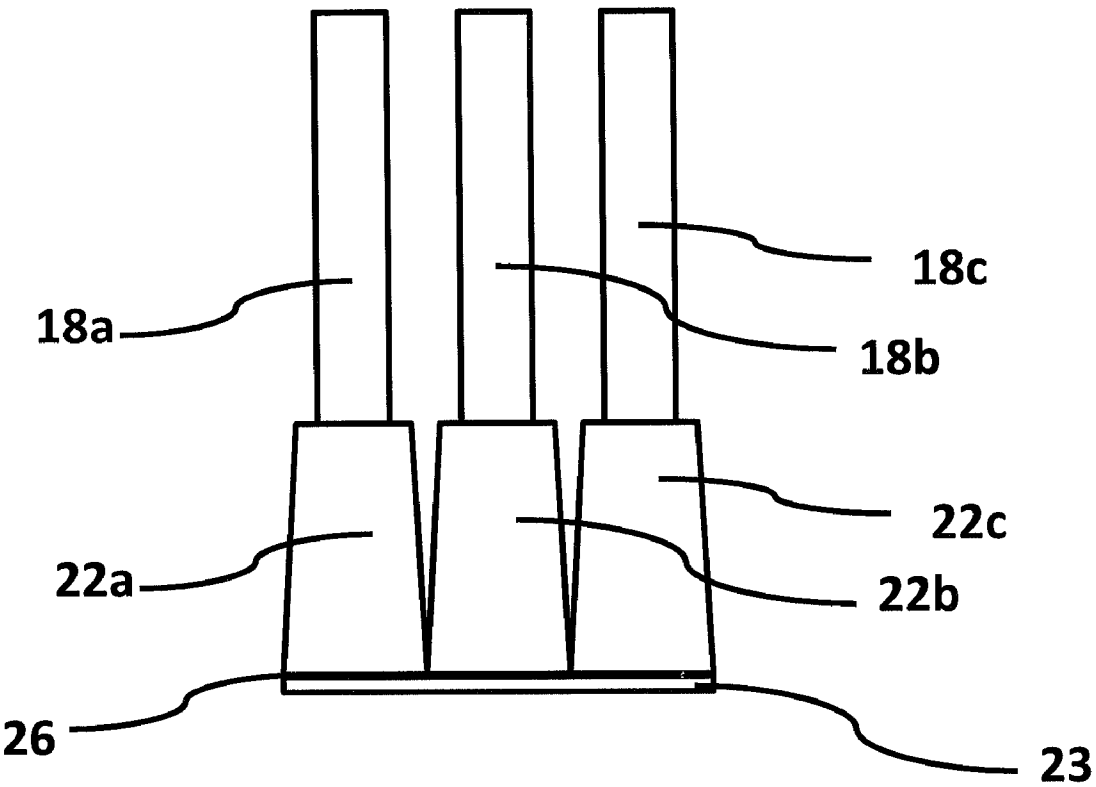
FIG. 10 is a schematic view of tuft holders joined by a hinge according to one embodiment of this invention.

The operation of the brush 10 shown in FIGS. 5-10 will now be described. The operation of this embodiment is similar to the embodiment shown in FIGS. 1-4, so only the substantive differences will be discussed. Tuft holders 22*a*, 22*b*, 22*c* can be hinged at the bottom portion 29 with hinges 26*a*, 26*b*, as shown in FIG. 9. In one embodiment, hinges 26*a*, 26*b* are living hinges. In another embodiment, tuft holders 22*a*, 22*b*, 22*c* can be operatively connected at bottom portion 29 with binder 23, as shown in FIG. 10. Hinge 26 is formed at the interface between tuft holders 22*a*, 22*b*, 22*c*, and binder 23. Binder 23 can be formed from the same material as tuft holders 22*a*, 22*b*, 22*c*, or from any other suitable material chosen by one skilled in the art.

Figure 11:
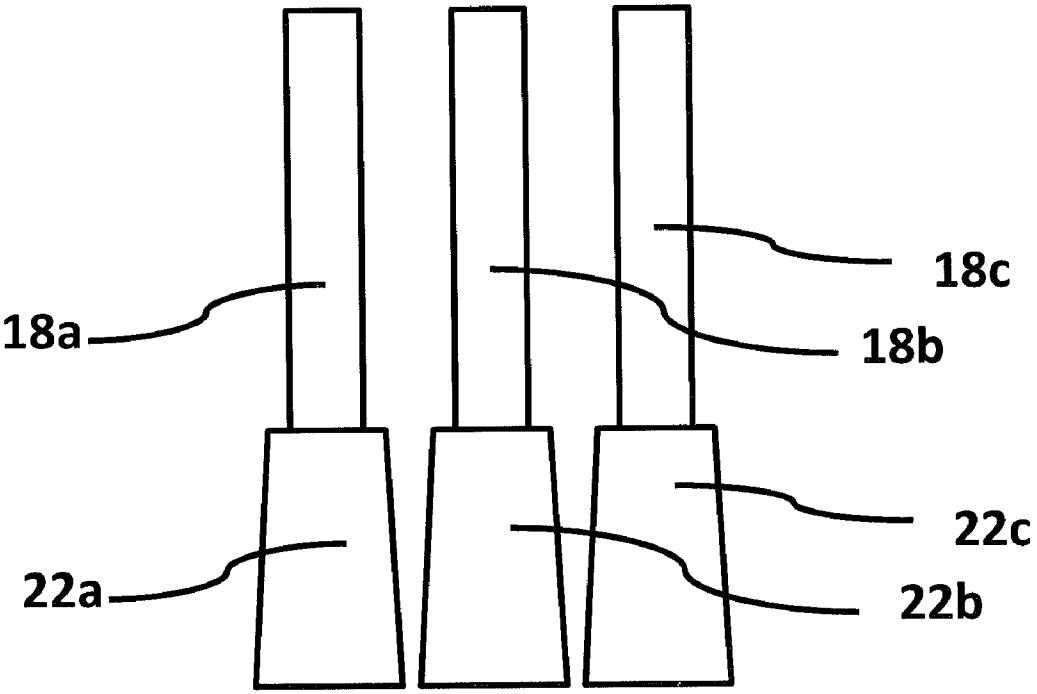
FIG. 11 is a schematic view of tuft holders according to yet another embodiment of this invention.

The operation of the brush 10 shown in FIG. 11 will now be described. The operation of this embodiment is also similar to the embodiment shown in FIGS. 1-4, so only the substantive differences will be discussed. This embodiment uses individual tuft holders 22*a*, 22*b*, 22*c* that are not interconnected to each other in any way and thus act as independent components. As a result, the tuft holders 22*a*, 22*b*, 22*c* can be individually attached and detached from support structure 13.

Figure 12:
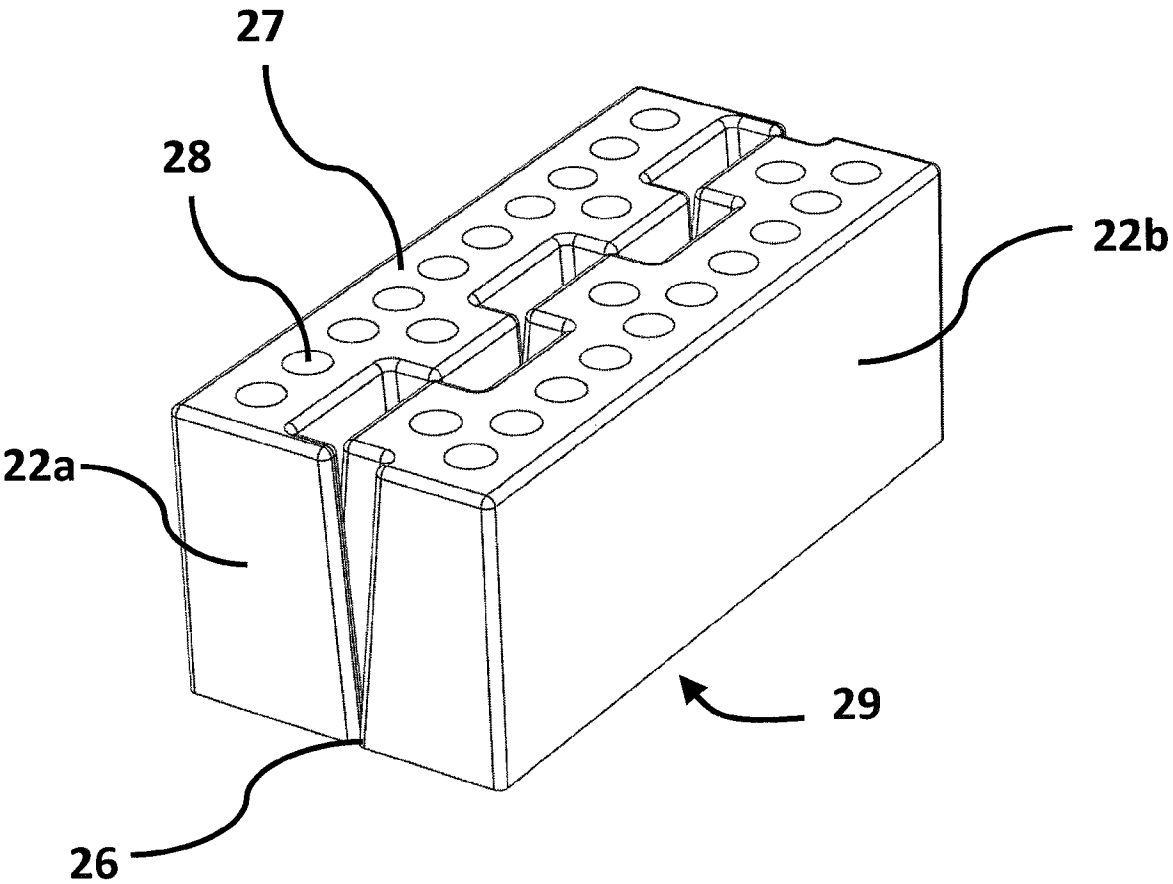
FIG. 12 is a perspective view of tuft holders according to another embodiment of this invention.
Figure 13:
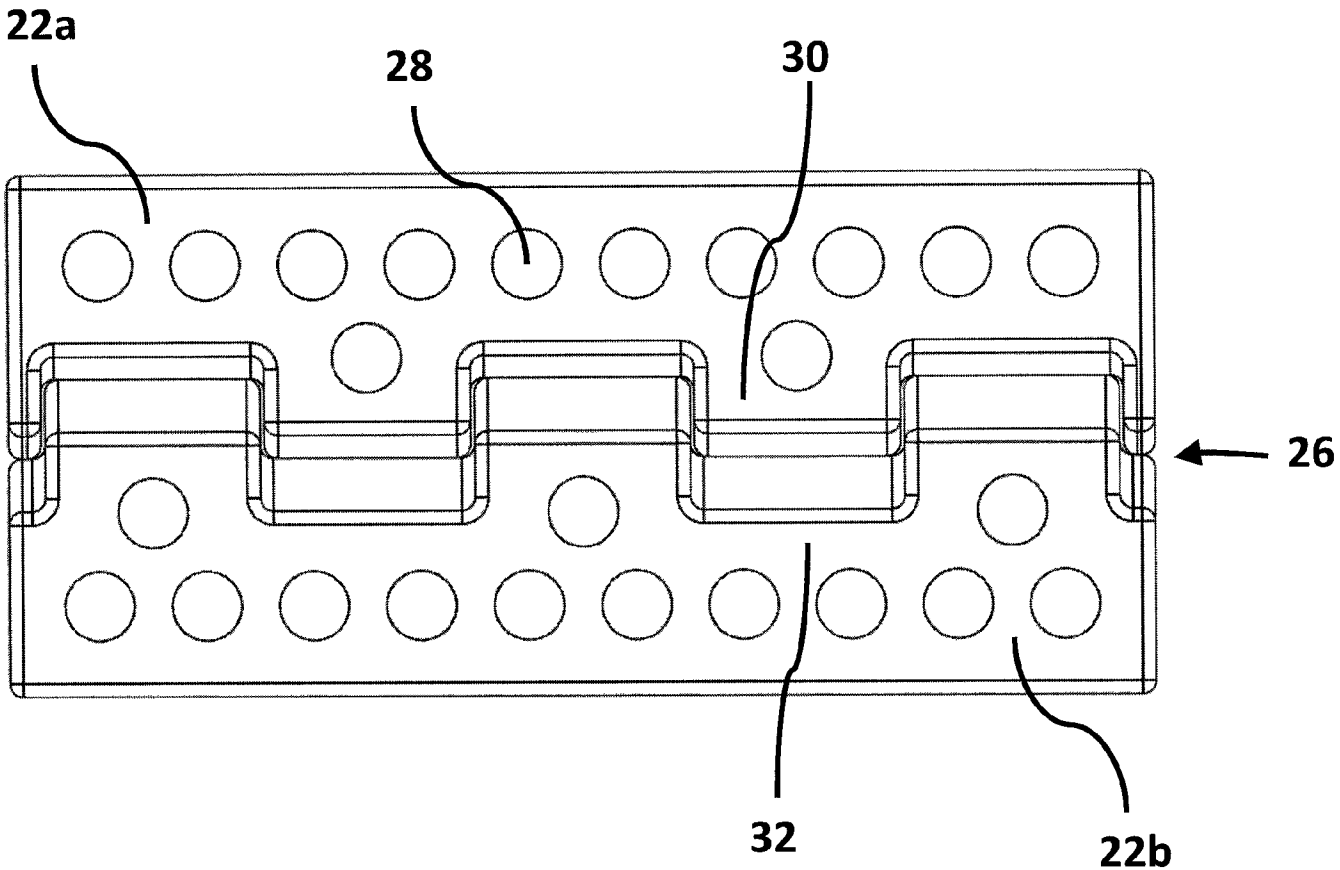
FIG. 13 is a top view of the tuft holders shown in FIG. 12.

The operation of the brush 10 shown in FIGS. 12-14 will now be described. The operation of this embodiment is similar to the embodiment shown in FIGS. 1-4, so only the substantive differences will be discussed. This embodiment has two tuft holders 22*a*, 22*b* operatively connected at hinge 26. Each of the tuft holders 22*a*, 22*b* have a row 40 of tufts 18 and additional tufts 18 located on each ridge 30. These additional tufts 18 form a middle third row.

The operation of the brush 10 shown in FIGS. 19*a*, 19*b*, 20*a*, and 20*b* will now be described. The operation of this embodiment is similar to the embodiment shown in FIGS. 1-4, so only the substantive differences will be discussed. The brush 10 may include a tuft holder assembly 16, which includes one or more tuft holders 22. The support structure 13 of the brush 10 can be at least partially hollow and have a wall 11 defining an interior volume for receiving the tuft holder assembly 16. The support structure 13 may secure tuft holder assembly 16 to the brush 10. In one embodiment, tuft holder assembly 16 is slidably attached to the support structure 13. The brush 10 may include an adjustment mechanism 50 for moving the tuft holder assembly 16 from a first use condition, where the tuft holders 22, 22, 22 are not movable with respect to each other, as shown in FIGS. 19*a* and 20*a*, to a second non-use or cleaning condition, where at least one tuft holder 22 is movable with respect to another tuft holder 22, as shown in FIGS. 19*b* and 20*b*. The adjustment mechanism 50 may also move the tuft holder assembly 16 from second condition to the first condition. The adjustment mechanism 50 can be moved or pushed in a direction F, moving the tuft holder assembly 16 from the first condition to the second condition. The adjustment mechanism 50 can be moved or pulled in a direction G, moving the tuft holder assembly 16 from the second condition back to the first condition. When the brush 10 is in the second condition, tuft holders 22 may move relative to each other in directions H and I via hinges 26. In one embodiment, the tuft holder assembly 16 remains attached to the brush 10 in both the first condition and the second condition and during the transition between the first and second conditions.

With continuing reference to the operation of the brush 10 shown in FIGS. 19*a*, 19*b*, 20*a*, and 20*b*, the adjustment mechanism 50 may include a rod 52. In one embodiment, the adjustment mechanism 50 includes a rod 52 and a piston 54. The piston 54 may be a separate component operatively attached to the adjustment rod 50, or the piston 54 may form a portion of the adjustment rod 50. The adjustment rod 52 or the piston 54 may contact the tuft holder assembly 16. In one embodiment, the adjustment rod 52 is a separate component from the brush 10. In this embodiment, the adjustment rod 52 is inserted into the brush 10, and the adjustment rod 52 or piston 54 contacts the tuft holder assembly 16. Alternately, the adjustment rod 52 may be operatively attached to the tuft holder assembly 16. In one embodiment, the adjustment rod 52 is fixedly attached to tuft holder assembly 16. In another embodiment, adjustment rod 52 is removable attached to the tuft holder assembly 16. In an alternate embodiment, the adjustment mechanism 50 includes a release mechanism 56. The release mechanism 56 may lock in the first condition and may release when a force is exerted on the release mechanism 56 in the general direction J. After the release mechanism 56 is released, the release mechanism 56 can move in the direction F. The support structure 13 of the brush 10 may include a slot 58 for receiving a portion of the release mechanism 56 and guiding the sliding motion of the release mechanism 56. The slot 58 may be sized to limit the amount of travel in both the direction F and the direction G. The slot 58 may extend through the wall 11 and allow the release mechanism 56 to attach to the tuft holder assembly 56. The slot 58 may have a larger opening or aperture 59 located near one end for receiving a locking portion of the release mechanism 56. The locking portion is sized to fit within the opening 59 and maintain or lock the release mechanism 56 in the first condition. When the release mechanism 56 is moved to the first condition, the locking portion of the release mechanism 56 may lock or snap into the opening 59 to maintain the brush 10 in the first condition. The shape of the opening 59 and the locking portion may be substantially similar. The shape of the opening 59 and the locking portion may be substantially rectangular, substantially circular, substantially elliptical, substantially triangular, or any other shape chosen with skill in the art.

With continuing reference to the operation of the brush 10 shown in FIGS. 19*a*, 19*b*, 20*a*, and 20*b*, the brush 10 may be biased to remain in the first condition. In another embodiment, the brush 10 may be biased to return to the first condition. In another embodiment, the brush 10 may be biased to return and remain in the first condition. A biasing device may be used to bias the brush 10, the tuft holder assembly 16, and/or the adjustment mechanism 50 to remain in and/or return to the first condition. In one embodiment, the biasing device moves the brush 10 from the second condition to the first condition when the adjustment mechanism 50 is released. The biasing device may be any resilient or elastic material or device chosen by one skilled in the art, including, but not limited to, any type of spring, rib, and/or flexible clip or snap. The biasing device may be one or more flexible or elastic ribs located on the interior of the wall 11, the adjustment mechanism 50, the adjustment rod 52, the piston 54, and/or the tuft holder assembly 16. The one or more ribs may be paired with channels, conduits, openings, or apertures. The biasing device may be any type of spring operatively connected to the support structure 13 and operatively connected to the tuft holder assembly 16 for biasing the brush 10 to remain and/or return to the first condition. The biasing device may be any type of clip or snap, which may engage a channel, conduit, opening, or aperture for biasing the brush 10 to remain in the first condition. In one embodiment, the release mechanism 56 includes a biasing device to remain in the first condition.

The operation of the brush 10 shown in FIGS. 21-27 will now be described. The brush 10 of this invention may be adjustable between: (1) a first non-use or cleaning condition, shown in FIGS. 22 and 23, where at least one tuft holder 22*a* is movable with respect to another tuft holder 22*b* and, (2) a second use condition, shown in FIG. 21, where the tuft holders 22*a*, 22*b* are not movable with respect to each other. To adjust the brush 10 from the first condition to the second condition, the tuft holders 22*a*, 22*b* are slid onto the brush tray 70, with the ridges 74*a*, 74*b* on the brush tray 70 sliding into the groove 72 in each of the tuft holders 22*a*, 22*b*, until each of the tuft holders 22*a*, 22*b* contacts the wall 75. The fit between the ridges 74*a*, 74*b* and grooves 72, 72 may be any type of fit chosen by one skilled in the art. Then the brush tray 70 is inserted into the attachment device 14, with the projections 76*a*, 76*b* entering the apertures 78*a*, 78*b*. The projections 76*a*, 76*b* engage the apertures 78*a*, 78*b* to secure the brush tray 70 to the attachment device 14. In one embodiment, the projections 76*a*, 76*b* snap or lock into the apertures 78*a*, 78*b* to secure the brush tray 70 to the attachment device 14. When the brush tray 70 is secured to the attachment device 14, the sides or walls 77*a*, 77*b*, 77*c*, 77*d* may assist maintaining the tuft holders 22*a*, 22*b* on the brush tray 70. In one embodiment, the sides or walls 77*a*, 77*b*, 77*c*, 77*d* maintain the position of the tuft holders 22*a*, 22*b* on the brush tray 70 in at least one direction. To return the brush 10 from the second condition to the first condition, the projections 76*a*, 76*b* are depressed, which disengages them from the apertures 78*a*, 78*b*. The brush tray 70 can then be removed from the attachment device 14 by several different methods, including but not limited to, pushing up on the projections 76*a*, 76*b*, pulling up on the tufts 18*a*, 18*b* or tuft holders 22*a*, 22*b*, lifting the brush tray 70 out of the opening 79 in the attachment device 14, or tipping the brush 10 upside down. Once the brush tray 70 has been removed from the attachment device 14, the tuft holders 22 can be slid off the brush tray 70 for cleaning, storage, or replacement.

Numerous embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

We claim:

1. A brush comprising:

a first tuft holder including at least one tuft fixedly attached to the first tuft holder;

a second tuft holder including at least one tuft fixedly attached to the second tuft holder, wherein the second tuft holder is operatively attached to the first tuft holder;

a support structure fixedly attached to a handle that is used to grasp and use the brush, wherein the first and second tuft holders are slidable together with respect to the support structure between first and second positions;

an adjustment mechanism for adjusting the brush between (1) a first condition where: (a) the first and second tuft holders are slid together with respect to the support structure to the first position and; (b) the first and second tuft holders are not movable with respect to each other; and, (2) a second condition where: (a) the first and second tuft holders are slid together with respect to the support structure to the second position and; (b) the first tuft holder is movable with respect to the second tuft holder; and, wherein the first and second tuft holders remain attached to the support structure in the first and second conditions.

2. The brush of claim 1, wherein the first tuft holder is pivotally attached to the second tuft holder with a hinge.

3. The brush of claim 2, wherein the first tuft holder pivots with respect to the second tuft holder about the hinge when the brush is in the second condition.

4. The brush of claim 3, wherein the adjustment mechanism contacts the first tuft holder for adjusting the brush between the first condition and the second condition.

5. The brush o claim 4, wherein the adjustment mechanism is fixedly attached to the first tuft holder.

6. The brush of claim 5 wherein:

the brush further comprises a release mechanism that is lockable to lock the adjustment mechanism in the first condition;

the support structure has a slot; and, the release mechanism comprises a component that extends from the first tuft holder through the slot in the support structure.

7. The brush of claim 6 wherein:

the slot in the support structure has a first end where the slot defines a larger opening than the rest of the slot; and, the larger opening receives a locking portion of the release mechanism.

8. The brush of claim 7, wherein the brush is biased with a biasing device comprising a spring to remain in the first condition.

9. A method of adjusting a brush comprising the steps of:

(A) providing a first tuft holder including at least one tuft fixedly attached to the first tuft holder;

(B) providing a second tuft holder including at least one tuft fixedly attached to the second tuft holder, wherein the second tuft holder is operatively attached to the first tuft holder;

(C) providing a support structure fixedly attached to a handle that is used to grasp and use the brush, wherein the first and second tuft holders are slidable together with respect to the support structure between first and second positions, and wherein the first and second tuft holders remain attached to the support structure throughout the entire method of adjusting the brush; and, (D) using an adjustment mechanism to slide the first and second tuft holders together with respect to the support structure between (1) the first position causing a first condition where the first and second tuft holders are not movable with respect to each other; and, (2) the second position causing a second condition where the first tuft holder is movable with respect to the second tuft holder.

10. The method of claim 9 wherein the first tuft holder is pivotally attached to the second tuft holder with a hinge and the second condition comprises the step of pivoting the first tuft holder with respect to the second tuft holder about the hinge.

11. The method of claim 10 wherein the method further comprises the steps of:

providing the support structure with a slot; and, providing the brush with a release mechanism that is lockable to lock the adjustment mechanism in the first condition, wherein the release mechanism comprises a component that extends from the first tuft holder through the slot in the support structure.

12. The method of claim 11 wherein:

the slot in the support structure has a first end where the slot defines a larger opening than the rest of the slot; and, the method further comprises the step of: positioning a locking portion of the release mechanism into the larger opening to lock the release mechanism.

13. The method of claim 12 wherein the method further comprises the steps of: providing the adjustment mechanism with a biasing device comprising a spring; and, using the biasing device to bias the brush in the first condition.

* * * * *